US012503847B2

(12) United States Patent
Bellissimo et al.

(10) Patent No.: US 12,503,847 B2
(45) Date of Patent: Dec. 23, 2025

(54) CONNECTORS FOR ASSEMBLING MODULAR BUILDING UNITS

(71) Applicant: Buildz, LLC, Forest City, NC (US)

(72) Inventors: Mark Joseph Bellissimo, Wellington, FL (US); Robert Francis Kelsch, Hendersonville, NC (US); Stanley Clark Beard, Jr., Hendersonville, NC (US); Jason Daryl Hunsinger, Forest City, NC (US)

(73) Assignee: Buildz, LLC, Forest City, NC (US)

( * ) Notice: Subject to any disclaimer, the term of this patent is extended or adjusted under 35 U.S.C. 154(b) by 425 days.

(21) Appl. No.: 18/251,889

(22) PCT Filed: Nov. 11, 2021

(86) PCT No.: PCT/US2021/058922

§ 371 (c)(1),
(2) Date: May 5, 2023

(87) PCT Pub. No.: WO2022/103928

PCT Pub. Date: May 19, 2022

(65) Prior Publication Data

US 2024/0011283 A1 Jan. 11, 2024

Related U.S. Application Data

(60) Provisional application No. 63/112,484, filed on Nov. 11, 2020.

(51) Int. Cl.

| | |
|---|---|
| ***E04B 1/61*** | (2006.01) |
| ***E04B 1/343*** | (2006.01) |
| ***E04B 1/348*** | (2006.01) |

(52) U.S. Cl.

CPC ..... *E04B 1/6112* (2013.01); *E04B 1/34321* (2013.01); *E04B 1/34815* (2013.01)

(58) Field of Classification Search

CPC . E04B 1/6112; E04B 1/34321; E04B 1/34815

(Continued)

(56) References Cited

U.S. PATENT DOCUMENTS 733,500 A * 7/1903 Moore ..... E04B 1/2604 403/381
3,008,550 A * 11/1961 Miles ..... E04B 2/7455 52/210

(Continued)

FOREIGN PATENT DOCUMENTS

CN 110847381 A * 2/2020 ..... E04B 1/10
WO 2004/051017 A1 6/2004

OTHER PUBLICATIONS

Communication Under Rule 71(3) EPC from EP Application No. 21820050.9 dated Mar. 15, 2024.

(Continued)

*Primary Examiner* — Brian D Mattei
*Assistant Examiner* — Joseph J. Sadlon
(74) *Attorney, Agent, or Firm* — Michele V. Frank; Venable LLP

(57) ABSTRACT

A connector system for interconnecting vertically adjacent and/or laterally adjacent modular units of a building constructed from such modular units assembled rigidly together includes connectors that are rigidly attached to the modular units. These connectors are able to rigidly interlock with each other so that, when the connectors of adjacent modular units are interlocked with each other, the adjacent modular units are also rigidly attached to each other. The connectors include sliding alignment features that ensure that resist lateral displacement of laterally adjacent modular units and also ensure proper alignment of vertically-engaging retention features that resist vertical displacement of vertically adjacent modular units.

34 Claims, 17 Drawing Sheets

(58) Field of Classification Search
USPC ..... 52/281
See application file for complete search history.

(56) References Cited

U.S. PATENT DOCUMENTS

| | | | | | |
|---|---|---|---|---|---|
| 3,082,555 | A * | 3/1963 | Hill | E02F 9/28 | 37/453 |
| 3,303,626 | A * | 2/1967 | Brigham | F16B 5/0068 | 52/800.17 |
| 3,438,164 | A * | 4/1969 | Duepree | A47B 47/05 | 52/630 |
| 3,732,659 | A * | 5/1973 | LaBarge | E04B 1/6803 | 52/204.597 |
| 3,760,551 | A * | 9/1973 | Konig | E04B 1/6112 | 52/285.1 |
| 4,020,611 | A * | 5/1977 | Amos | E04B 2/7411 | 52/417 |
| 4,067,155 | A * | 1/1978 | Ruff | E04B 1/6803 | 52/287.1 |
| 4,112,647 | A * | 9/1978 | Scheid | E04B 2/7411 | 52/586.1 |
| 4,867,598 | A * | 9/1989 | Winter, IV | E04B 2/08 | 403/381 |
| 5,125,204 | A * | 6/1992 | Porter | E04F 13/0803 | 52/762 |
| 5,247,773 | A * | 9/1993 | Weir | E04B 1/615 | 403/381 |
| 5,291,716 | A * | 3/1994 | Broberg | E04B 1/3483 | 52/745.03 |
| 5,546,720 | A | 8/1996 | LaBruzza | | |
| D376,754 | S * | 12/1996 | Livingston | D8/377 | |
| 5,735,639 | A | 4/1998 | Payne et al. | | |
| 5,860,759 | A * | 1/1999 | Leicht | A47B 87/002 | 5/9.1 |
| 6,016,632 | A * | 1/2000 | McGee | E06B 3/9636 | 52/584.1 |
| 6,843,025 | B2 * | 1/2005 | Paz | A01K 1/033 | 52/282.1 |
| 7,350,829 | B2 * | 4/2008 | Dyal | F15B 13/0896 | 403/331 |
| 8,245,467 | B2 * | 8/2012 | Lewis | B64D 11/00 | 52/287.1 |
| 8,453,414 | B2 * | 6/2013 | Simmons | F16B 9/09 | 403/231 |
| 8,745,931 | B2 * | 6/2014 | Hutter | E04B 1/355 | 52/79.5 |
| 8,789,325 | B2 * | 7/2014 | Verhaeghe | E04B 2/705 | 52/561 |
| 9,988,812 | B2 * | 6/2018 | Kalinowski | E05D 5/02 | |
| 10,179,991 | B2 * | 1/2019 | Houghton | E04H 9/021 | |
| 10,196,807 | B2 * | 2/2019 | Kwong | E04B 1/6166 | |
| 10,933,501 | B2 * | 3/2021 | Bisson | B23Q 15/06 | |
| 11,071,384 | B2 * | 7/2021 | Blewett | A47B 96/066 | |
| 11,135,525 | B2 * | 10/2021 | Rieber | E04B 1/3445 | |
| 11,598,104 | B2 * | 3/2023 | Volponi | E04F 21/1877 | |
| 11,629,489 | B2 * | 4/2023 | Ebisu | E04B 1/612 | 52/592.1 |
| 2004/0101357 | A1 * | 5/2004 | Dijkstra | B65D 7/24 | 403/403 |

OTHER PUBLICATIONS

Extended European Search Report from EP Application No. 24184477.8 dated Oct. 24, 2024, 9 pages.
International Search Report and Written Opinion from PCT/US2021/058922 dated Feb. 14, 2022.

* cited by examiner

CONNECTORS FOR ASSEMBLING MODULAR BUILDING UNITS

CROSS-REFERENCE TO RELATED APPLICATION

This application is a National Stage Application under 35 U.S.C. § 371 of PCT/US2021/058922 filed on Nov. 11, 2021, which claims priority benefit from U.S. Provisional Patent Application No. 63/112,484, filed on Nov. 11, 2020, the entire content of each of which is incorporated herein by reference.

TECHNICAL FIELD

The subject matter disclosed herein relates generally to the construction of modular construction units. In particular, the presently disclosed subject matter relates to a connector system for constructing a building by assembling a plurality of modular units to rigidly interconnect the modular units to resist separation forces in the vertical and/or lateral directions, as well as associated methods of manufacture thereof.

BACKGROUND

In the field of modular construction, buildings are constructed from a plurality of pre-fabricated modular building units assembled together according to a plan of assembly for the final structure of the building. Such modular building units can include, for example, one or more rooms within the building. Such modular building units are pre-fabricated at a location (e.g., a factory) away from the site where the building (e.g., any suitable structure, including a temporary or permanent structure) is being constructed, transported to the building site, and assembled per the specifications of the building being constructed. In order to ensure that the structure is sufficiently watertight, it is often necessary to affix an exterior cladding, which can be both decorative and functional, over the exposed surface of the modular units that are on an outer surface of the building after the modular units are assembled together during construction of the building. However, it is also required during assembly of the building being constructed to precisely align adjacent modular units and to attach the modular units rigidly together. As such, it is a labor-intensive process to align adjacent modular units with sufficient precision and it is necessary to apply a plurality of different types of fasteners to secure the adjacent modular units together during the assembly phase, only to require further different fasteners for later securing the cladding over the exterior of the modular units. As such, a need exists for a sufficiently rigid connector that can ensure precise alignment of adjacent modular units while also holding the modular units together in a manner that resists loads that would cause the modular units to separate after assembly and also are able to allow for the precise alignment of a cladding over the exterior surface of the modular unit.

SUMMARY

According to an example aspect, a connector system for rigidly interconnecting a plurality of modular units of a structure (e.g., a building) is provided, the connector system comprising: a first connector configured for attachment at an attachment position of a first modular unit of the plurality of modular units, the first connector comprising a vertically extending retention clip, an alignment slot, and a channel; a second connector configured for attachment at an attachment position of a second modular unit of the plurality of modular units, the second connector comprising a retention tab, an alignment slot, and a channel, wherein the second modular unit is vertically adjacent to the first modular unit, such that the attachment position of the second modular unit is directly below the attachment position of the first modular unit when the connector system is in an assembled state; a third connector configured for attachment at an attachment position of a third modular unit of the plurality of modular units, the third connector comprising a retention clip and an alignment peg, wherein the third modular unit is laterally adjacent to the first modular unit, such that the attachment position of the third modular unit is directly beside the attachment position of the first modular unit when the connector system is in the assembled state; and a fourth connector configured for attachment at an attachment position of a fourth modular unit of the plurality of modular units, the fourth connector comprising a retention tab and an alignment peg, wherein the fourth modular unit is laterally adjacent to the second modular unit and vertically adjacent to the third modular unit, such that the attachment position of the fourth modular unit is directly beside the attachment position of the second modular unit and directly below the attachment position of the third modular unit when the connector system is in the assembled state. The retention tab of the second connector is configured for vertical insertion into the retention clip of the first connector to resist vertical movement of the first connector relative to the second connector. The retention tab of the fourth connector is configured for vertical insertion into the retention clip of the third connector to resist vertical movement of the fourth connector relative to the third connector. The alignment peg of the third connector is configured for sliding engagement within the channel of the first connector to resist lateral movement of the first connector relative to the third connector. The alignment peg of the fourth connector is configured for sliding engagement within the channel of the second connector to resist lateral movement of the second connector relative to the fourth connector. Thus, using this connector system, relative movement between the first, second, third, and fourth modular units is resisted by respective engagements between the first, second, third, and fourth connectors.

In some embodiments of the connector system, the retention clip of the first connector comprises a finger attached to a front wall of the first connector and a plurality of serrations, wherein the finger is spaced apart from the front wall of the first connector by a gap; the retention tab of the second connector comprises a plurality of serrations formed on an external surface of the retention tab that faces towards the plurality of serrations of the retention clip of the first connector when the retention tab is inserted into the gap of the retention clip; and the finger of the retention clip of the first connector is configured to exert a compressive force on the retention tab of the second connector when the retention tab is inserted into the gap of the retention clip, such that the plurality of serrations of the retention tab are pressed against and interlockingly engaged with the plurality of serrations of the retention clip.

In some embodiments of the connector system, the retention clip of the third connector comprises a finger attached to a front wall of the third connector and a plurality of serrations, wherein the finger is spaced apart from the front wall of the third connector by a gap; the retention tab of the fourth connector comprises a plurality of serrations formed on an external surface of the retention tab that faces towards the plurality of serrations of the retention clip when the retention tab is inserted into the gap of the retention clip of the third connector when the retention tab is inserted into the gap of the retention clip; and the finger of the retention clip of the third connector is configured to exert a compressive force on the retention tab of the fourth connector when the retention tab is inserted into the gap of the retention clip, such that the plurality of serrations of the retention tab are pressed against and interlockingly engaged with the plurality of serrations of the retention clip.

In some embodiments of the connector system, the retention clip of the first connector comprises a finger attached to a front wall of the first connector and a plurality of serrations, wherein the finger is spaced apart from the front wall of the first connector by a gap; the retention tab of the second connector comprises a plurality of serrations formed on an external surface of the retention tab that faces towards the plurality of serrations of the retention clip of the first connector when the retention tab is inserted into the gap of the retention clip; and the finger of the retention clip of the first connector is configured to exert a compressive force on the retention tab of the second connector when the retention tab is inserted into the gap of the retention clip, such that the plurality of serrations of the retention tab are pressed against and interlockingly engaged with the plurality of serrations of the retention clip; and the retention clip of the third connector comprises a finger attached to a front wall of the third connector and a plurality of serrations, wherein the finger is spaced apart from the front wall of the third connector by a gap; the retention tab of the fourth connector comprises a plurality of serrations formed on an external surface of the retention tab that faces towards the plurality of serrations of the retention clip when the retention tab is inserted into the gap of the retention clip of the third connector when the retention tab is inserted into the gap of the retention clip; and the finger of the retention clip of the third connector is configured to exert a compressive force on the retention tab of the fourth connector when the retention tab is inserted into the gap of the retention clip, such that the plurality of serrations of the retention tab are pressed against and interlockingly engaged with the plurality of serrations of the retention clip.

In some embodiments of the connector system, when the alignment peg of the third connector is positioned within the channel of the first connector, relative movement between the first connector and the third connector is restricted in all directions other than a direction of the sliding engagement of the alignment peg of the third connector within the channel of the first connector.

In some embodiments of the connector system, when the alignment peg of the fourth connector is positioned within the channel of the second connector, relative movement between the second connector and the fourth connector is restricted in all directions other than a direction of the sliding engagement of the alignment peg of the third connector within the channel of the first connector.

In some embodiments of the connector system, when the alignment peg of the third connector is positioned within the channel of the first connector, relative movement between the first connector and the third connector is restricted in all directions other than a direction of the sliding engagement of the alignment peg of the third connector within the channel of the first connector; and when the alignment peg of the fourth connector is positioned within the channel of the second connector, relative movement between the second connector and the fourth connector is restricted in all directions other than a direction of the sliding engagement of the alignment peg of the third connector within the channel of the first connector.

In some embodiments of the connector system, the alignment slot of each of the first and second connectors has a tapered shape between an inlet of the alignment slot and the channel, such that a width of the alignment slot at the inlet is greater than a width of the channel at any point along a length of the channel.

In some embodiments of the connector system, the width of the channel of the first connector is greater than or equal to a diameter of a collar of the alignment peg of the third connector and is smaller than a diameter of a head of the alignment peg of the third connector.

In some embodiments of the connector system, the width of the channel of the second connector is greater than or equal to a diameter of a collar of the alignment peg of the fourth connector and is smaller than a diameter of a head of the alignment peg of the fourth connector.

In some embodiments of the connector system, the width of the channel of the first connector is greater than or equal to a diameter of a collar of the alignment peg of the third connector and is smaller than a diameter of a head of the alignment peg of the third connector; and the width of the channel of the second connector is greater than or equal to a diameter of a collar of the alignment peg of the fourth connector and is smaller than a diameter of a head of the alignment peg of the fourth connector.

In some embodiments of the connector system, the length of the channel of the first connector is an axial length and is greater than an axial length of the retention tab of the fourth connector, such that, during assembly of the connector system, the alignment peg of the third connector is inserted into the channel of the first connector before the retention tab of the fourth connector is inserted into the retention clip of the third connector, such that engagement of the alignment peg of the third connector within the channel of the first connector ensures the retention tab of the fourth connector is axially aligned with the gap of the retention clip of the third connector.

In some embodiments of the connector system, the alignment peg comprises a collar and a radially extending head, the head being wider than the width of the channel.

In some embodiments of the connector system, the alignment peg of the third connector is provided on a side wall of the third connector; the alignment slot of the first connector is provided on a side wall of the first connector and comprises opposing flanges that, together, define the tapered shape of the alignment slot and also the width of the channel of the second connector and are shaped to prevent removal of the alignment peg of the third connector from the channel of the first connector in a lateral direction; the alignment peg of the fourth connector is provided on a side wall of the fourth connector; and the alignment slot of the second connector is provided on a side wall of the second connector and comprises opposing flanges that, together, define the tapered shape of the alignment slot and also the width of the channel of the second connector and are shaped to prevent removal of the alignment peg of the fourth connector from the channel of the second connector in the lateral direction.

In some embodiments of the connector system, the side wall and the front wall of the first connector are joined to each other at an angle; the side wall and the front wall of the second connector are joined to each other at an angle; the side wall and the front wall of the third connector are joined to each other at an angle; and the side wall and the front wall of the fourth connector are joined to each other at an angle In some embodiments of the connector system, when the connector system is in the assembled state, the side walls of the first, second, third, and fourth connectors are each parallel to each other.

In some embodiments of the connector system, when the connector system is in the assembled state, the front walls of the first, second, third, and fourth connectors are each parallel to and/or coplanar with each other.

In some embodiments of the connector system, when the connector system is in the assembled state, the side walls of the first, second, third, and fourth connectors are each parallel to each other and the front walls of the first, second, third, and fourth connectors are each parallel to and/or coplanar with each other.

In some embodiments of the connector system, the second connector comprises a top wall configured for attachment to a top surface of the second modular unit; and the fourth connector comprises a top wall configured for attachment to a top surface of the fourth modular unit.

In some embodiments of the connector system, the side wall and the front wall of the first connector each extend in a respective plane that is perpendicular to each other; the side wall, the front wall, and the top wall of the second connector each extend in a respective plane that is perpendicular to each other; the side wall and the front wall of the third connector each extend in a respective plane that is perpendicular to each other; and the side wall, the front wall, and the top wall of the fourth connector each extend in a respective plane that is perpendicular to each other.

In some embodiments of the connector system, each of the first, second, third, and fourth connectors comprises a cladding alignment feature on a front wall thereof, each cladding alignment feature being configured to secure a cladding member or panel to the first, second, third, and fourth connectors.

In some embodiments, the connector system comprises: one or more fifth connectors arranged along a lower edge of the first modular unit and/or along a lower edge of the third modular unit according to a predetermined pattern, each of the one or more fifth connectors comprising a retention clip; and one or more sixth connectors arranged along an upper edge of the second modular unit and/or along an upper edge of the fourth modular unit according to the predetermined pattern, each of the one or more sixth connectors comprising a retention tab. When the connector assembly is in the assembled state, the upper edge of the second modular unit is adjacent to the lower edge of the first modular unit and the upper edge of the fourth modular unit is adjacent to the lower edge of the third modular unit. The retention tab of each of the one or more sixth connectors is configured for vertical insertion into the retention clip of a corresponding fifth connector of the one or more fifth connectors to resist vertical movement of the first modular unit relative to the second modular unit and/or of the third modular unit relative to the fourth modular unit.

In some embodiments of the connector system, a direction of the sliding engagement of the alignment peg of the third connector within the alignment slot of the first connector is coaxial with a direction of insertion of the retention tab of the second connector into the retention clip of the first connector.

In some embodiments of the connector system, the retention tab of the fourth connector can only be vertically inserted into the retention clip of the third connector when the alignment peg of the third connector is positioned within the channel of the first connector.

In any of these embodiments of the connector system, the attachment position of the first modular unit can be a corner of the first modular unit; the attachment position of the second modular unit can be a corner of the second modular unit; the attachment position of the third modular unit can be a corner of the third modular unit; and/or the attachment position of the fourth modular unit can be a corner of the fourth modular unit.

According to another example aspect, a method of rigidly interconnecting a plurality of modular units of a structure (e.g., building) is provided, the method comprising: attaching a first connector at an attachment position of a first modular unit of the plurality of modular units, the first connector comprising a vertically extending retention clip, an alignment slot, and a channel; attaching a second connector at an attachment position of a second modular unit of the plurality of modular units, the second connector comprising a retention tab, an alignment slot, and a channel, wherein the second modular unit is vertically adjacent to the first modular unit, such that the attachment position of the second modular unit is directly below the attachment position of the first modular unit when the connector system is in an assembled state; attaching a third connector at an attachment position of a third modular unit of the plurality of modular units, the third connector comprising a retention clip and an alignment peg, wherein the third modular unit is laterally adjacent to the first modular unit, such that the attachment position of the third modular unit is directly beside the attachment position of the first modular unit when the connector system is in the assembled state; attaching a fourth connector at an attachment position of a fourth modular unit, the fourth connector comprising a retention tab and an alignment peg, wherein the fourth modular unit is laterally adjacent to the second modular unit and vertically adjacent to the third modular unit, such that the attachment position of the fourth modular unit is directly beside the attachment position of the second modular unit and directly below the attachment position of the third modular unit when the connector system is in the assembled state; vertically inserting the retention tab of the second connector into the retention clip of the first connector to resist vertical movement of the first connector relative to the second connector; vertically inserting the retention tab of the fourth connector into the retention clip of the first connector to resist vertical movement of the first connector relative to the second connector; slidably engaging the alignment peg of the third connector within the channel of the first connector to resist lateral movement of the first connector relative to the third connector; slidably engaging the alignment peg of the fourth connector within the channel of the second connector to resist lateral movement of the second connector relative to the fourth connector; and resisting relative movement between the first, second, third, and fourth modular units by respective engagements between the first, second, third, and fourth connectors.

In some embodiments of the method, the retention clip of the first connector comprises a finger attached to a front wall of the first connector and a plurality of serrations, wherein the finger is spaced apart from the front wall of the first connector by a gap; and the retention tab of the second connector comprises a plurality of serrations formed on an external surface of the retention tab that faces towards the plurality of serrations of the retention clip of the first connector when the retention tab is inserted into the gap of the retention clip; and the method comprises exerting, using the finger of the retention clip of the first connector, a compressive force on the retention tab of the second connector when the retention tab is inserted into the gap of the retention clip, such that the plurality of serrations of the retention tab are pressed against and interlockingly engaged with the plurality of serrations of the retention clip.

In some embodiments of the method, the retention clip of the third connector comprises a finger attached to a front wall of the third connector and a plurality of serrations, wherein the finger is spaced apart from the front wall of the third connector by a gap; and the retention tab of the fourth connector comprises a plurality of serrations formed on an external surface of the retention tab that faces towards the plurality of serrations of the retention clip when the retention tab is inserted into the gap of the retention clip of the third connector when the retention tab is inserted into the gap of the retention clip; and the method comprises exerting, using the finger of the retention clip of the third connector, a compressive force on the retention tab of the fourth connector when the retention tab is inserted into the gap of the retention clip, such that the plurality of serrations of the retention tab are pressed against and interlockingly engaged with the plurality of serrations of the retention clip.

In some embodiments of the method, the retention clip of the first connector comprises a finger attached to a front wall of the first connector and a plurality of serrations, wherein the finger is spaced apart from the front wall of the first connector by a gap; and the retention tab of the second connector comprises a plurality of serrations formed on an external surface of the retention tab that faces towards the plurality of serrations of the retention clip of the first connector when the retention tab is inserted into the gap of the retention clip; and the method comprises exerting, using the finger of the retention clip of the first connector, a compressive force on the retention tab of the second connector when the retention tab is inserted into the gap of the retention clip, such that the plurality of serrations of the retention tab are pressed against and interlockingly engaged with the plurality of serrations of the retention clip; and the retention clip of the third connector comprises a finger attached to a front wall of the third connector and a plurality of serrations, wherein the finger is spaced apart from the front wall of the third connector by a gap; and the retention tab of the fourth connector comprises a plurality of serrations formed on an external surface of the retention tab that faces towards the plurality of serrations of the retention clip when the retention tab is inserted into the gap of the retention clip of the third connector when the retention tab is inserted into the gap of the retention clip; and the method comprises exerting, using the finger of the retention clip of the third connector, a compressive force on the retention tab of the fourth connector when the retention tab is inserted into the gap of the retention clip, such that the plurality of serrations of the retention tab are pressed against and interlockingly engaged with the plurality of serrations of the retention clip.

In some embodiments of the method, when the alignment peg of the third connector is positioned within the channel of the first connector, relative movement between the first connector and the third connector is restricted in all directions other than a direction of the sliding engagement of the alignment peg of the third connector within the channel of the first connector.

In some embodiments of the method, when the alignment peg of the fourth connector is positioned within the channel of the second connector, relative movement between the second connector and the fourth connector is restricted in all directions other than a direction of the sliding engagement of the alignment peg of the third connector within the channel of the first connector.

In some embodiments of the method, when the alignment peg of the third connector is positioned within the channel of the first connector, relative movement between the first connector and the third connector is restricted in all directions other than a direction of the sliding engagement of the alignment peg of the third connector within the channel of the first connector; and when the alignment peg of the fourth connector is positioned within the channel of the second connector, relative movement between the second connector and the fourth connector is restricted in all directions other than a direction of the sliding engagement of the alignment peg of the third connector within the channel of the first connector.

In some embodiments of the method, the alignment slot of each of the first and second connectors has a tapered shape between an inlet of the alignment slot and the channel, such that a width of the alignment slot at the inlet is greater than a width of the channel at any point along a length of the channel.

In some embodiments of the method, the width of the channel of the first connector is greater than or equal to a diameter of a collar of the alignment peg of the third connector and is smaller than a diameter of a head of the alignment peg of the third connector.

In some embodiments of the method, the width of the channel of the second connector is greater than or equal to a diameter of a collar of the alignment peg of the fourth connector and is smaller than a diameter of a head of the alignment peg of the fourth connector.

In some embodiments of the method, the width of the channel of the first connector is greater than or equal to a diameter of a collar of the alignment peg of the third connector and is smaller than a diameter of a head of the alignment peg of the third connector; and the width of the channel of the second connector is greater than or equal to a diameter of a collar of the alignment peg of the fourth connector and is smaller than a diameter of a head of the alignment peg of the fourth connector.

In some embodiments of the method, the length of the channel of the first connector is an axial length and is greater than an axial length of the retention tab of the fourth connector; and the method comprises, during assembly of the connector system, inserting the alignment peg of the third connector into the channel of the first connector before the retention tab of the fourth connector is inserted into the retention clip of the third connector, such that engagement of the alignment peg of the third connector within the channel of the first connector ensures the retention tab of the fourth connector is axially aligned with the gap of the retention clip of the third connector.

In some embodiments of the method, the alignment peg comprises a collar and a radially extending head, the head being wider than the width of the channel.

In some embodiments of the method, the alignment peg of the third connector is provided on a side wall of the third connector; the alignment slot of the first connector is provided on a side wall of the first connector and comprises opposing flanges that, together, define the tapered shape of the alignment slot and also the width of the channel of the second connector and are shaped to prevent removal of the alignment peg of the third connector from the channel of the first connector in a lateral direction; the alignment peg of the fourth connector is provided on a side wall of the fourth connector; and the alignment slot of the second connector is provided on a side wall of the second connector and comprises opposing flanges that, together, define the tapered shape of the alignment slot and also the width of the channel of the second connector and are shaped to prevent removal of the alignment peg of the fourth connector from the channel of the second connector in the lateral direction.

In some embodiments of the method, the side wall and the front wall of the first connector are joined to each other at an angle; the side wall and the front wall of the second connector are joined to each other at an angle; the side wall and the front wall of the third connector are joined to each other at an angle; and the side wall and the front wall of the fourth connector are joined to each other at an angle.

In some embodiments of the method, when the connector system is in the assembled state, the side walls of the first, second, third, and fourth connectors are each parallel to each other.

In some embodiments of the method, when the connector system is in the assembled state, the front walls of the first, second, third, and fourth connectors are each parallel to and/or coplanar with each other.

In some embodiments of the method, when the connector system is in the assembled state, the side walls of the first, second, third, and fourth connectors are each parallel to each other and the front walls of the first, second, third, and fourth connectors are each parallel to and/or coplanar with each other.

In some embodiments of the method, the second connector comprises a top wall configured for attachment to a top surface of the second modular unit; and the fourth connector comprises a top wall configured for attachment to a top surface of the fourth modular unit.

In some embodiments of the method, the side wall and the front wall of the first connector each extend in a respective plane that is perpendicular to each other; the side wall, the front wall, and the top wall of the second connector each extend in a respective plane that is perpendicular to each other; the side wall and the front wall of the third connector each extend in a respective plane that is perpendicular to each other; and the side wall, the front wall, and the top wall of the fourth connector each extend in a respective plane that is perpendicular to each other.

In some embodiments of the method, each of the first, second, third, and fourth connectors comprises a cladding alignment feature on a front wall thereof; and the method comprises securing, using each cladding alignment feature, a cladding member or panel to the first, second, third, and fourth connectors.

In some embodiments, the method comprises arranging one or more fifth connectors along a lower edge of the first modular unit and/or along a lower edge of the third modular unit according to a predetermined pattern, each of the one or more fifth connectors comprising a retention clip; arranging one or more sixth connectors along an upper edge of the second modular unit and/or along an upper edge of the fourth modular unit according to the predetermined pattern, each of the one or more sixth connectors comprising a retention tab; and vertically inserting the retention tab of each of the one or more sixth connectors into the retention clip of a corresponding fifth connector of the one or more fifth connectors to resist vertical movement of the first modular unit relative to the second modular unit and/or of the third modular unit relative to the fourth modular unit; when the connector assembly is in the assembled state, the upper edge of the second modular unit is adjacent to the lower edge of the first modular unit and the upper edge of the fourth modular unit is adjacent to the lower edge of the third modular unit.

In some embodiments of the method, a direction of the sliding engagement of the alignment peg of the third connector within the alignment slot of the first connector is coaxial with a direction of insertion of the retention tab of the second connector into the retention clip of the first connector.

In some embodiments of the method, the retention tab of the fourth connector can only be vertically inserted into the retention clip of the third connector when the alignment peg of the third connector is positioned within the channel of the first connector.

In any of these embodiments of the method, the attachment position of the first modular unit can be a corner of the first modular unit; the attachment position of the second modular unit can be a corner of the second modular unit; the attachment position of the third modular unit can be a corner of the third modular unit; and/or the attachment position of the fourth modular unit can be a corner of the fourth modular unit.

According to another example aspect, a connector system is provided, the connector system comprising: a first connector configured for attachment to a corner of a first modular unit, the first connector comprising a vertically extending retention clip and an alignment slot; a second connector configured for attachment to a corner of a second modular unit, vertically adjacent to the corner of the first modular unit, the second modular unit comprising a retention tab; and a third connector configured for attachment to a corner of a third modular unit, laterally adjacent to the corner of the first modular unit, the third modular unit comprising an alignment peg; wherein the retention tab is configured for vertical insertion within a gap formed between the retention clip and a front wall of the first modular unit to restrict vertical movement of the first modular unit relative to the second modular unit; wherein the alignment peg is configured for insertion within the alignment slot to restrict lateral movement of the first modular unit relative to the third modular unit; and wherein relative movement between the first, second, and third module units is prevented by respective engagements between the first, second, and third connectors.

In some embodiments of the connector system, the retention tab comprises a plurality of serrations on a surface thereof configured for insertion within the gap formed between the retention clip and the front wall; the retention clip or the front wall comprises a plurality of serrations on a surface thereof against which the plurality of serrations on the surface of the retention tab are arranged; and the retention clip is configured to press the plurality of serrations of the retention tab against the plurality of serrations of the retention clip or the front wall to interlock the plurality of serrations of the retention tab with the plurality of serrations of the retention clip or the front wall.

In some embodiments of the connector system, the alignment slot comprises an inlet and a channel, wherein, when the alignment peg is positioned within the channel, relative movement between the first modular unit and the third modular unit is restricted.

In some embodiments of the connector system, the alignment slot is tapered between the inlet and the channel, such that the alignment slot is wider at the inlet than in the channel.

In some embodiments of the connector system, the channel has a width that is substantially similar to a width of a collar of the alignment peg.

In some embodiments of the connector system, the channel has a length that is greater than a length of the retention tab, such that the alignment peg is configured to be inserted within the channel prior to the retention tab being inserted within the gap between the retention clip and the front wall, such that the retention tab is aligned with the gap.

In some embodiments of the connector system, the alignment peg comprises a collar and a radially extending head, the head being wider than the width of the channel.

In some embodiments of the connector system, the alignment slot comprises a flange that defines the width of the channel and is configured to prevent removal of the head from the alignment slot in a lateral direction.

In some embodiments, the connector system comprises a fourth connector configured for attachment to a corner of a fourth modular unit, laterally adjacent to the second modular unit and vertically adjacent to the third modular unit, the fourth modular unit comprising an alignment peg and a retention tab; wherein the second modular unit comprises an alignment slot; and wherein the third modular unit comprises a retention clip.

In some embodiments of the connector system, the retention tab of the fourth connector is configured for vertical insertion within a gap formed between the retention clip and a front wall of the third connector to restrict vertical movement of the third modular unit relative to the fourth modular unit; wherein the alignment peg of the fourth connector is configured for insertion within the alignment slot of the second connector to restrict lateral movement of the fourth modular unit relative to the second modular unit; and wherein relative movement between the first, second, third, and fourth module units is prevented by the engagements between the first, second, third, and fourth connectors.

In some embodiments of the connector system, each of the first, second, and third connectors comprises a cladding alignment feature on a front wall thereof, each cladding alignment feature being configured to secure a cladding member or panel to the first, second, and third connectors.

In some embodiments, the connector system comprises: one or more fifth connectors arranged along an edge of the first modular unit according to a predetermined pattern, each of the one or more fifth connectors comprising a retention tab; and one or more sixth connectors arranged along an edge of the second modular unit, adjacent to the edge of the first modular unit, according to the predetermined pattern, each of the one or more sixth connectors comprising a retention clip; wherein the retention tab of each of the one or more sixth connectors is configured for vertical insertion within a gap formed between the retention clip and a front wall of the fifth connector to restrict vertical movement of the first modular unit relative to the second modular unit.

According to another example aspect, a method of assembling a plurality of modular units is provided, the method comprising: attaching a first connector to a corner of a first modular unit, the first connector comprising a vertically extending retention clip and an alignment slot; attaching a second connector to a corner of a second modular unit, vertically adjacent to the corner of the first modular unit, the second modular unit comprising a retention tab; attaching a third connector to a corner of a third modular unit, laterally adjacent to the corner of the first modular unit, the third modular unit comprising an alignment peg; vertically inserting the retention tab within a gap formed between the retention clip and a front wall of the first modular unit to restrict vertical movement of the first modular unit relative to the second modular unit; inserting the alignment peg within the alignment slot to restrict lateral movement of the first modular unit relative to the third modular unit; and preventing relative movement between the first, second, and third module units by respective engagements between the first, second, and third connectors.

In some embodiments of the method, the retention tab comprises a plurality of serrations on a surface thereof configured for insertion within the gap formed between the retention clip and the front wall; and the retention clip or the front wall comprises a plurality of serrations on a surface thereof against which the plurality of serrations on the surface of the retention tab are arranged; the method comprising pressing, using the retention clip, the plurality of serrations of the retention tab against the plurality of serrations of the retention clip or the front wall to interlock the plurality of serrations of the retention tab with the plurality of serrations of the retention clip or the front wall.

In some embodiments of the method, the alignment slot comprises an inlet and a channel, wherein, when the alignment peg is positioned within the channel, relative movement between the first modular unit and the third modular unit is restricted.

In some embodiments of the method, the alignment slot is tapered between the inlet and the channel, such that the alignment slot is wider at the inlet than in the channel.

In some embodiments of the method, the channel has a width that is substantially similar to a width of a collar of the alignment peg.

In some embodiments of the method, the channel has a length that is greater than a length of the retention tab; the method comprising inserting the alignment peg within the channel prior to the retention tab being inserted within the gap between the retention clip and the front wall, such that the retention tab is aligned with the gap.

In some embodiments of the method, the alignment peg comprises a collar and a radially extending head, the head being wider than the width of the channel.

In some embodiments of the method, the alignment slot comprises a flange that defines the width of the channel and is configured to prevent removal of the head from the alignment slot in a lateral direction.

In some embodiments, the method comprises attaching a fourth connector to a corner of a fourth modular unit, laterally adjacent to the second modular unit and vertically adjacent to the third modular unit, the fourth modular unit comprising an alignment peg and a retention tab; wherein the second modular unit comprises an alignment slot; and wherein the third modular unit comprises a retention clip.

In some embodiments, the method comprises vertically inserting the retention tab of the fourth connector within a gap formed between the retention clip and a front wall of the third connector to restrict vertical movement of the third modular unit relative to the fourth modular unit; and inserting the alignment peg of the fourth connector within the alignment slot of the second connector to restrict lateral movement of the fourth modular unit relative to the second modular unit; wherein relative movement between the first, second, third, and fourth module units is prevented by the engagements between the first, second, third, and fourth connectors.

In some embodiments of the method, each of the first, second, and third connectors comprises a cladding alignment feature on a front wall thereof; the method comprising securing, using each cladding alignment feature, a cladding member or panel to the first, second, and third connectors.

In some embodiments, the method comprises arranging one or more fifth connectors along an edge of the first modular unit according to a predetermined pattern, each of the one or more fifth connectors comprising a retention tab; arranging one or more sixth connectors along an edge of the second modular unit, adjacent to the edge of the first modular unit, according to the predetermined pattern, each of the one or more sixth connectors comprising a retention clip; and vertically inserting the retention tab of each of the one or more sixth connectors within a gap formed between the retention clip and a front wall of the fifth connector to restrict vertical movement of the first modular unit relative to the second modular unit.

DETAILED DESCRIPTION

Figure 1:
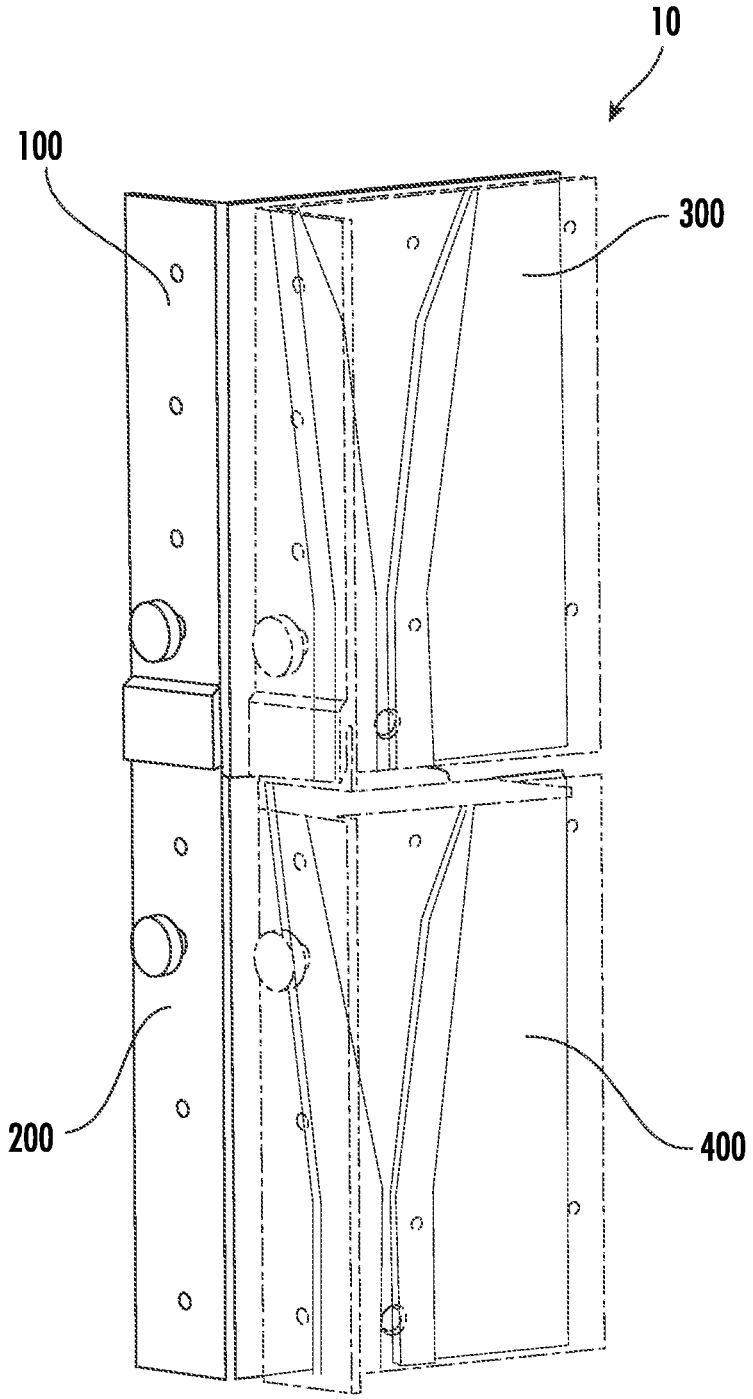
FIG. 1 is an isometric view of an example embodiment of a connector system for rigidly securing modular units together during assembly of a structure.

The accompanying figures and description are merely examples of a single example embodiment for a modular elevator system, as well as methods of production and assembly therefor. As such, the foregoing description and accompanying figures are illustrative and are not to be used to limit the scope of the presently disclosed subject matter.

Unless defined otherwise, all technical and scientific terms used herein have the same meaning as commonly understood to one having ordinary skill in the art to which the presently disclosed subject matter belongs. Although, any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in this application, including the claims. Thus, for example, reference to "a fastener hole" can include a plurality of such fastener holes, and so forth.

Unless otherwise indicated, all numbers expressing quantities of length, diameter, width, and so forth used in the specification and claims are to be understood as being modified in all instances by the terms "about" or "approximately". Accordingly, unless indicated to the contrary, the numerical parameters set forth in this specification and attached claims are approximations that can vary depending upon the desired properties sought to be obtained by the presently disclosed subject matter.

As used herein, the terms "about" and "approximately," when referring to a value or to a length, width, diameter, temperature, time, volume, concentration, percentage, etc., is meant to encompass variations of in some embodiments ±20%, in some embodiments ±10%, in some embodiments ±5%, in some embodiments ±1%, in some embodiments ±0.5%, and in some embodiments ±0.1% from the specified amount, as such variations are appropriate for the disclosed apparatuses and devices.

The term "comprising", which is synonymous with "including" "containing" or "characterized by" is inclusive or open-ended and does not exclude additional, unrecited elements or method steps. "Comprising" is a term of art used in claim language which means that the named elements are essential, but other elements can be added and still form a construct within the scope of the claim.

As used herein, the phrase "consisting of" excludes any element, step, or ingredient not specified in the claim. When the phrase "consists of" appears in a clause of the body of a claim, rather than immediately following the preamble, it limits only the element set forth in that clause; other elements are not excluded from the claim as a whole.

As used herein, the phrase "consisting essentially of" limits the scope of a claim to the specified materials or steps, plus those that do not materially affect the basic and novel characteristic(s) of the claimed subject matter.

With respect to the terms "comprising", "consisting of", and "consisting essentially of", where one of these three terms is used herein, the presently disclosed and claimed subject matter can include the use of either of the other two terms.

As used herein, the term "and/or" when used in the context of a listing of entities, refers to the entities being present singly or in combination. Thus, for example, the phrase "A, B, C, and/or D" includes A, B, C, and D individually, but also includes any and all combinations and sub-combinations of A, B, C, and D.

Figure 2:
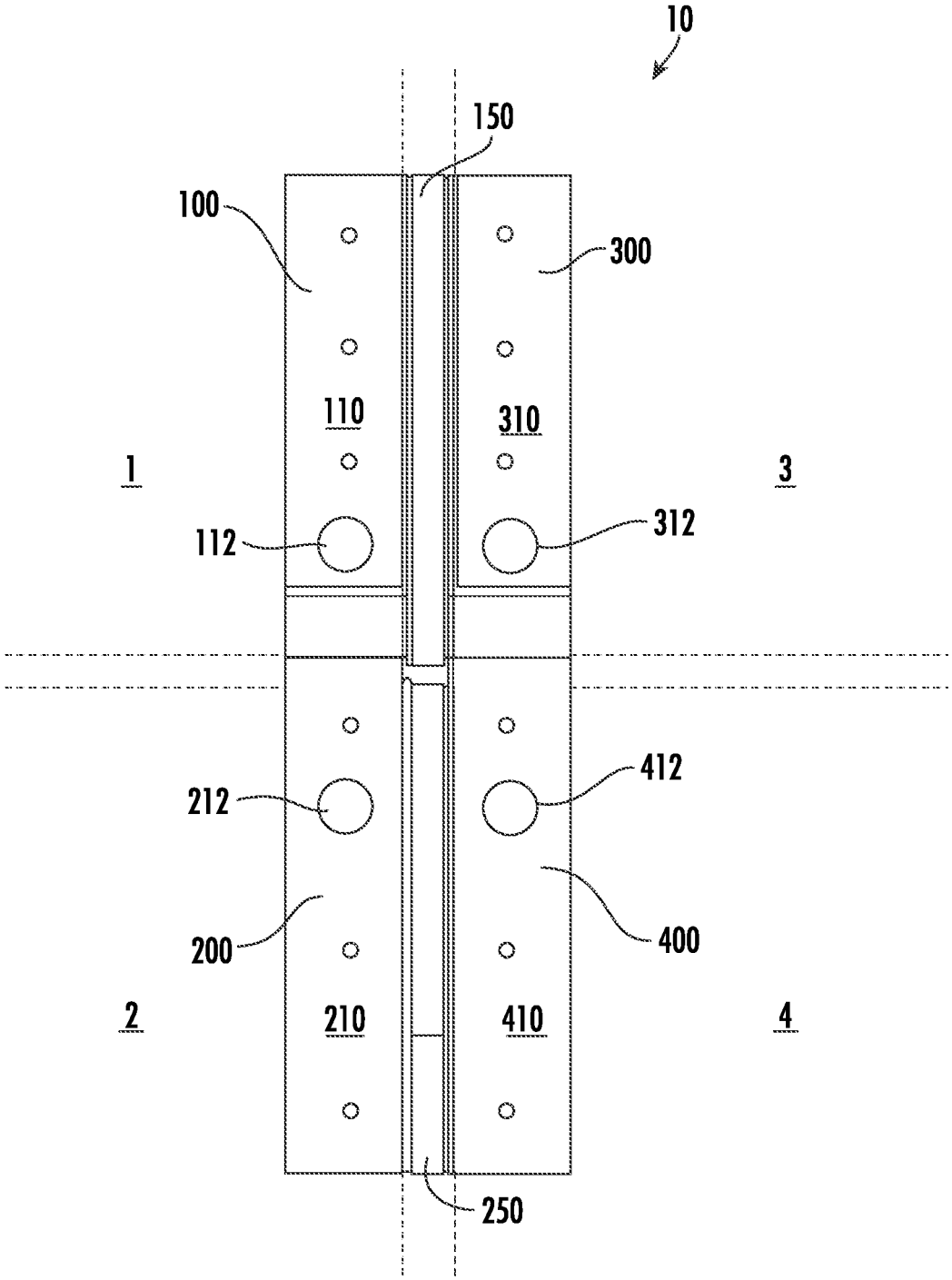
FIG. 2 is a front view of the example connector system of FIG. 1.

FIG. 1 is an isometric assembly view for an example embodiment of a connector system, generally designated 10. Such a connector system 10 is advantageously suitable, for example, in connecting adjacent modular units (e.g., one or more rooms, or portions of a room) of a building (e.g., any suitable structure, including a residential and/or commercial structure) together to provide precise alignment and interlocking between the adjacent modular units, while also providing precision attachment points for cladding panels that are designated for attachment to an exterior surface of the building and, hence, over the external surface of each of the modular units. As shown in FIGS. 1 and 2, the connector system 10 comprises a first connector 100, which is rigidly affixed to a corner of a first modular unit 1; a second connector 200, which is rigidly affixed to a corner of a second modular unit 2; a third connector 300, which is rigidly affixed to a corner of a third modular unit 3; and a fourth connector 400, which is rigidly affixed to a corner of a fourth modular unit 4.

In the orientation shown in FIGS. 1 and 2, the first modular unit 1, as well as the first connector 100 affixed to the first modular unit 1, are stacked on top of (e.g., vertically above) the second modular unit 2, as well as the second connector 200 affixed to the second modular unit 2, to form a first stack. The third modular unit 3, as well as the third connector 300 affixed to the third modular unit 3, is stacked on top of (e.g., vertically above) the fourth modular unit 4, as well as the fourth connector 400 affixed to the fourth modular unit 4, to form a second stack. The first stack is arranged adjacent to the second stack. As such, the first modular unit 1, as well as the first connector affixed to the first modular unit 1, is adjacent to (e.g., immediately beside in the horizontal direction, with no other modular units positioned therebetween) the third modular unit 3, as well as the third connector 300 affixed to the third modular unit 3. The second modular unit 2, as well as the second connector 200 affixed to the second modular unit 2, is adjacent to (e.g., immediately beside in the horizontal direction, with no other modular units positioned therebetween) the fourth modular unit 4, as well as the fourth connector 400 affixed to the fourth modular unit 4.

In the example embodiment shown in FIG. 2, the first connector 100 is connected to a lower right corner of the first modular unit 1, the second connector 200 is connected to an upper right corner of the second modular unit 2, the third connector 300 is connected to a lower left corner of the third modular unit 3, and the fourth connector 400 is connected to an upper left corner of the fourth modular unit 4. The corners referenced hereinabove are provided for reference herein and are not limited to such positions. Additionally, the descriptions of the corners (upper, lower, right, left) herein is based on the point of view shown in FIG. 2 and, as such, may be described differently from other perspectives and/or view angles. The connector system 10 can be installed at the front surface or the rear surface of the respective first through fourth modular units 1-4. In some embodiments, the connector system 10 can comprise additional connectors, attached to the modular units at other positions (e.g., along longitudinal edges, vertical edges, other corners, and the like without limitation).

Each of the first, second, third, and fourth connectors 100, 200, 300, 400 have features that ensure proper alignment of each immediately adjacent connector as the respective modular unit to which such connector is attached is positioned laterally adjacent to (e.g., immediately beside) and/or on top of (e.g., vertically above, in the manner of stacking) another of the modular units and also to ensure that the respective connectors are lockingly attached to each other to resist any separation forces (e.g., forces that would otherwise cause a separation of the modular units attached to each other by one of the respective connectors). Such features will be discussed further herein with regard to the accompanying figures.

While the structures of the connectors are generally illustrated and described in the respective example embodiments as being substantially and/or entirely planar in shape, the connectors disclosed herein are not limited to such shapes and/or profiles. For example and without limitation, any of the front wall, the side wall, and/or the top wall can have a convex or concave cross-sectional profile. In some embodiments, the shape of the front wall, the side wall, and/or the top wall can be a compound, or irregular, shape. For example, the front wall, the side wall, and/or the top wall can have a vertical cross-sectional shape that is convex or concave and a horizontal cross-sectional shape that is convex or concave. As used herein, the immediately hereinabove, the terms "horizontal" and "vertical" are not used to denote global directions, but are merely used to designate local directions of extension for each of the front wall, the side wall, and/or the top wall. Thus, for example, the "horizontal" direction of the front wall may be different, using a global cartesian coordinate system, from the "horizontal" direction of the side wall and/or the top wall. The front wall, the side wall, and/or the top wall can have any suitable shape and are advantageously shaped to have a same contour, or shape, as the surface of the modular unit of the building to which they are respectively attached. Additionally, the cladding alignment feature of each connector can be positioned to extend orthogonal to the front surface or at a non-orthogonal angle in the horizontal and/or vertical directions.

Aspects of an example embodiment of a first connector, generally designated 100, are shown in FIGS. 5A through 5E. The first connector 100 comprises a front wall 110, which is positioned against (e.g., directly) an outer wall of the modular unit (e.g., modular unit 1, see FIG. 2) to which the first connector 100 is attached, and a side wall 140, which is positioned against (e.g., directly) a different outer wall of the modular unit to which the first connector 100 is attached. The first connector 100 is attached to the modular unit by fasteners (e.g., nails, screws, or any other suitable attachment type without limitation) that pass through the fastener holes 101 that are formed through (e.g., entirely through) the front wall 110 and the side wall 140. In some embodiments, the front wall 110 and the side wall 140 are formed (e.g., by stamping and bending) as a unitary, or monolithic, structure. In some embodiments, the entire first connector 100 can be formed as a unitary, or monolithic, structure, such as via an additive manufacturing technique (e.g., using a so-called 3D printer).

In some embodiments, one or more alignment features may be provided on the first connector 100 to ensure proper alignment of the first connector 100 at the corner of a modular unit. An example of such an alignment feature can be a tab extending orthogonally to both the front wall 110 and the side wall 140, which is held against a third side of the modular unit while the fasteners are inserted into the modular unit via the fastener holes 101 formed in the front and side walls 110, 140. In some embodiments, this tab can be removably attached to the front wall 110 and/or the side wall 140, for example, by forming a weakened joint therebetween, such as via forming perforations where the tab is joined to the front wall 110 and/or the side wall 140. The quantity of the fastener holes 101 is merely exemplary and fewer or more fastener holes 101 can be provided; also, the fastening holes 101 can be formed at other locations of the first connector 100 from those shown in FIGS. 5A through 5E.

The front wall 110 has a retention clip 120 formed thereon and a cladding alignment feature 112 protruding from a surface of the front wall 110. The cladding alignment feature 112 has a generally mushroom-shaped profile, in which a collar of the cladding alignment feature 112 that is directly attached to the front wall 110 has a smaller diameter than a distal knob of the cladding alignment feature 112 that is spaced apart from the surface of the front wall 110 by the collar of the cladding alignment feature 112. Thus, the cladding alignment feature 112 is positioned, shaped, and configured to fit within (e.g., lockingly within) eyelets or other recesses in a cladding panel for securing the cladding panel to the exterior surface of the building. The retention clip 120 has, as best illustrated in the detailed view of FIG. 5C, one or more of (e.g., a plurality of) serrations 124 that are formed in a unitary manner with the front wall 110 and a finger 122. The serrations 124 are on a surface of the retention clip 120 that is separated from the finger 122 by an insertion gap 126. The finger 122 has a generally tapering shape and/or is formed such that the inlet of the gap 126 (e.g., the end of the gap 126 that is opposite where the finger 122 is attached to the front wall 110) is wider than a midpoint and/or end of the gap 126, thereby allowing for possible slight misalignments of a retention tab (see, e.g., 220, FIG. 6C) with the retention clip 120 during insertion of the retention tab 220 into the retention clip 120.

The side wall 140 has attached thereto (e.g., via fasteners or as a unitary, or monolithic, structure) a pair of opposing flanges 150 that, together, define an alignment slot 160. The flanges 150 have a first part that extends away from (e.g., in the direction of extension of the front wall 110) the side wall 140 and a second part that extends towards the opposing flange 150 (e.g., in the direction of extension of the side wall 140). In the example embodiment shown, the second part of the flanges 150 has a constant width over the first edge portion 152 and a tapering width over the second edge portion 154. Thus, over the entire length of the first edge portion 152, the flange 150 has a generally L-shaped cross-section and, over the entire length of the second edge portion 154, the length of the second part of the flange 150 decreases continuously in the length direction, such that only the first part of the flange 150 is present at the entrance of the alignment slot 160. In some embodiments, the width of the second part of the flange 150 is only defined by the first edge portion 152, such that each flange 150 has a substantially constant cross-sectional shape along the entire length thereof. The flanges 150 may extend the entire height of the side wall 140 of the first connector 100, or only a portion thereof.

Figure 5A:
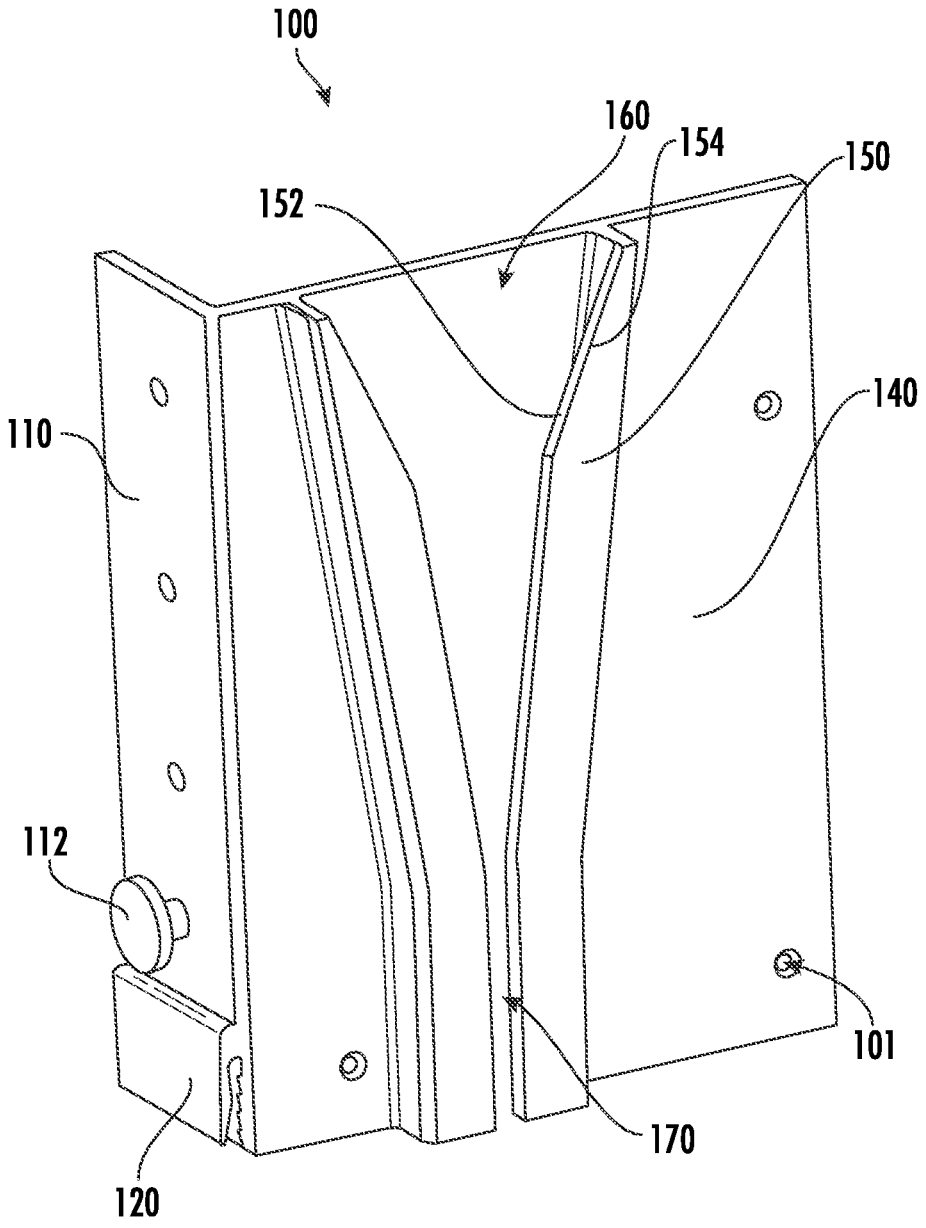
FIG. 5A is an isometric view of an example embodiment of a first connector used in the example connector system shown in FIGS. 1-4B.
Figure 5B:
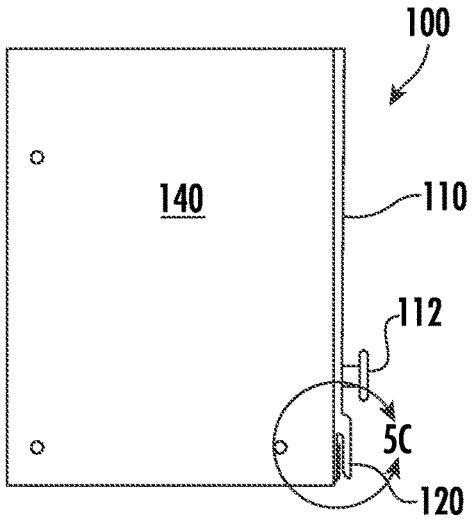
FIG. 5B is a side view of the first connector of FIG. 5A.
Figure 5C:
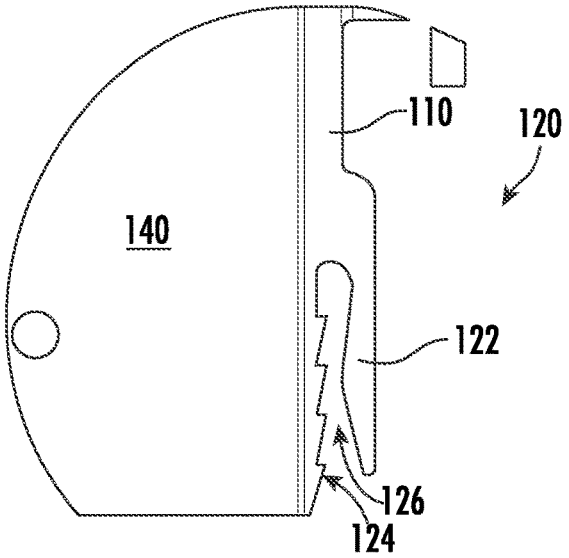
FIG. 5C is a detailed view of the portion of the first connector, as indicated in FIG. 5B.
Figure 5D:
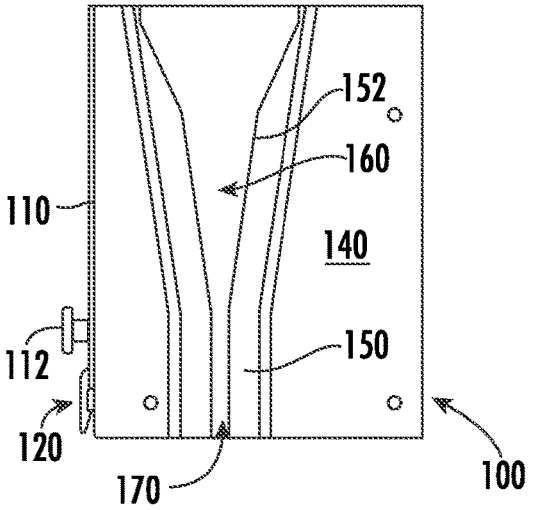
FIG. 5D is a side view of the first connector of FIG. 5A, from an opposite side to the view shown in FIG. 5B.
Figure 5E:
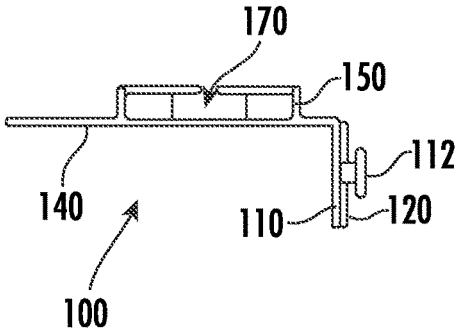
FIG. 5E is a top view of the first connector of FIG. 5A.
Figure 7A:
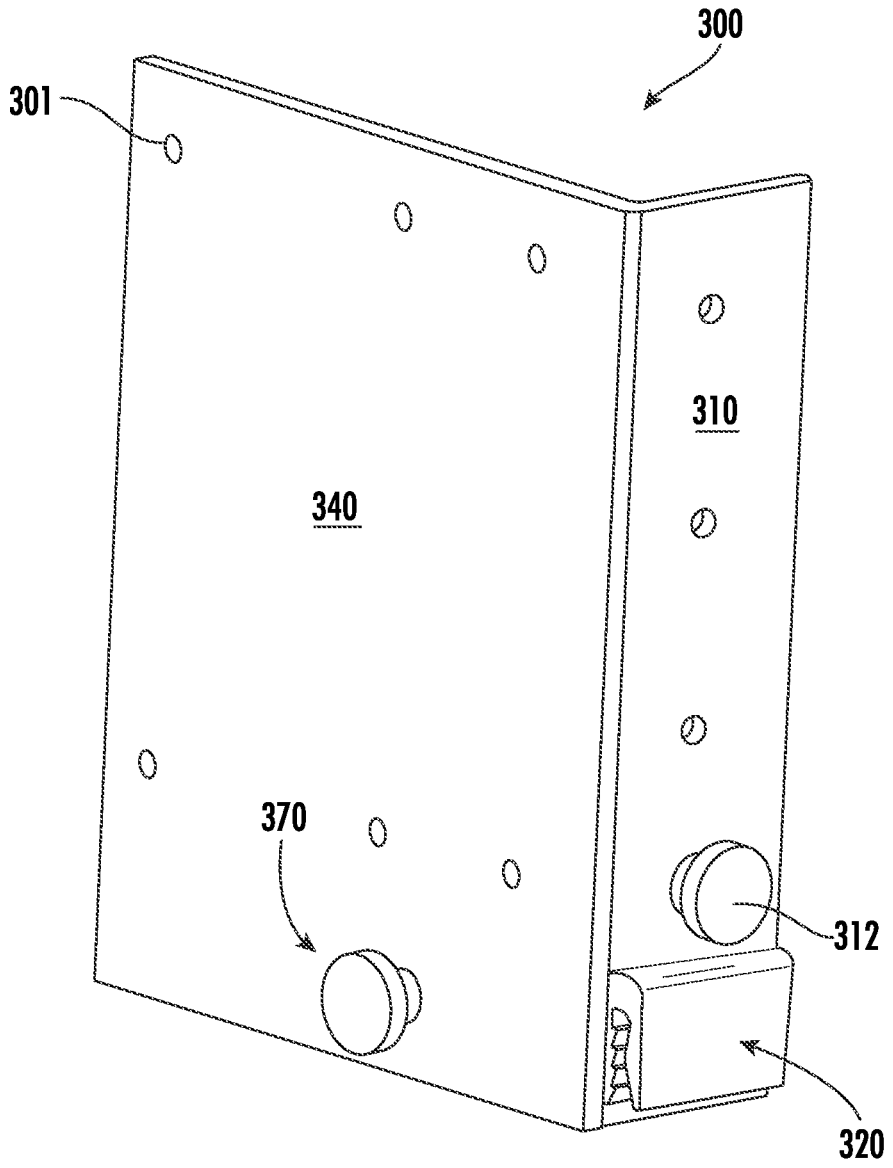
FIG. 7A is an isometric view of an example embodiment of a third connector used in the example connector system shown in FIGS. 1-4B.
Figure 7B:
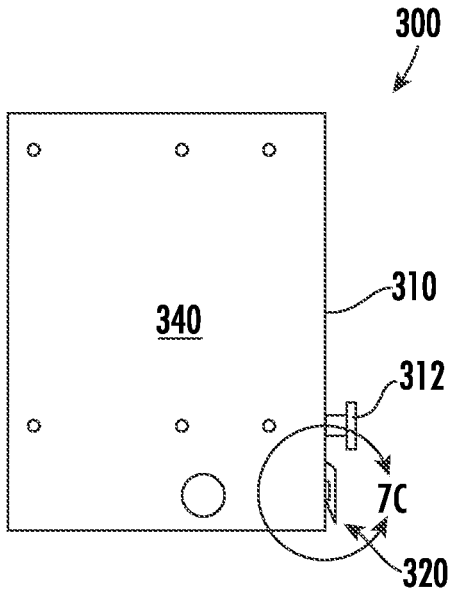
FIG. 7B is a side view of the third connector of FIG. 7A.
Figure 7C:
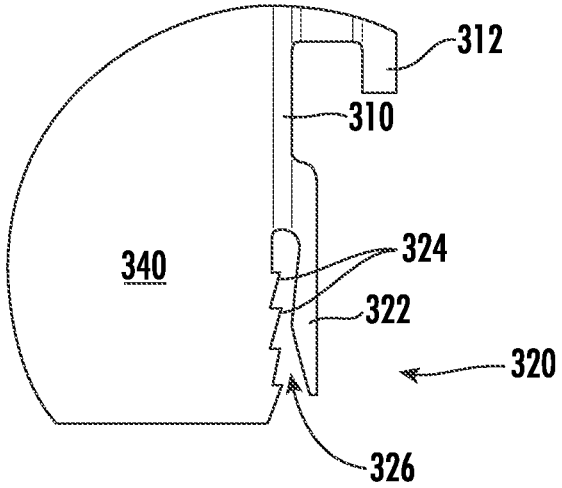
FIG. 7C is a detailed view of the portion of the third connector, as indicated in FIG. 7B.
Figure 7D:
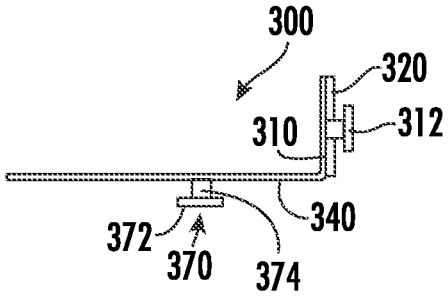
FIG. 7D is a top view of the third connector of FIG. 7A.
Figure 7E:
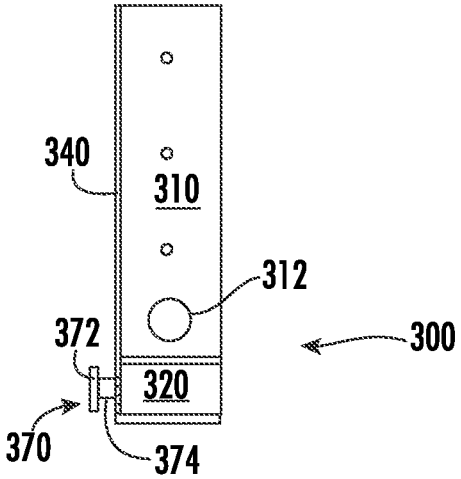
FIG. 7E is a front view of the third connector of FIG. 7A.

The cross-sectional area of the alignment slot 160 is thus defined by the side wall 140, the flanges 150, and the open region between the second portions of the opposing flanges 150. The flanges 150 are shaped such that, over the length of the alignment slot 160, the cross-sectional area of the alignment slot 160 decreases (e.g., continuously) as a function of length (e.g., is wider at the inlet of the alignment slot 160 and narrower at the opposing end, or outlet). Thus, the alignment slot 160 has a generally tapering shape. The flanges 150 form a channel, generally designated 170, which is continuous with the alignment slot 160, such that the outlet of the alignment slot 160 is coplanar with the inlet of the channel 170. The channel 170 has a substantially constant cross-sectional shape along the entire length thereof. The flanges 150 have a same cross-sectional shape along the entire length of the channel 170. The flanges 150 are spaced apart from each other along the entire length of the channel 170 by a distance that is greater than a diameter of the collar (see, e.g., 374, FIG. 7D) of the alignment peg (see, e.g., 370, FIG. 7D) and smaller than a diameter of the head (see, e.g., 372, FIG. 7D) of the alignment peg, such that the alignment peg can be inserted into or removed from the channel 170 only in the direction of the direction of extension of the channel 170. The flanges 150 are mirror images of each other as shown in FIG. 5A, but may be of any suitable shape and arrangement for securing an alignment peg therein.

Aspects of an example embodiment of a second connector, generally designated 200, are shown in FIGS. 6A through 6E. The second connector 200 comprises a front wall 210, which is positioned against (e.g., directly) an outer wall of the modular unit (e.g., modular unit 2, see FIG. 2) to which the second connector 200 is attached, and a side wall 240, which is positioned against (e.g., directly) a different outer wall of the modular unit to which the second connector 200 is attached. The second connector 200 is attached to the modular unit by fasteners (e.g., nails, screws, or any other suitable attachment type without limitation) that pass through the fastener holes 201 that are formed through (e.g., entirely through) the front wall 210 and the side wall 240. The second connector 200 also comprises a top wall 230, which extends at an angle (e.g., orthogonally) to the front wall 210 and the side wall 240. In some embodiments, the front wall 210, the side wall 240, and the top wall 230 are all formed (e.g., by stamping and bending) as a unitary, or monolithic, structure. In some embodiments, the entire second connector 200 can be formed as a unitary, or monolithic, structure, such as via an additive manufacturing technique (e.g., using a so-called 3D printer).

The top wall 230 is configured as an alignment feature, such that proper alignment of the second connector 200 at the corner of a modular unit is ensured (e.g., by the top wall 230 resting on the top surface of the modular unit while fasteners are inserted into the modular unit via the fastener holes 201). In some embodiments, the top wall 230 can be removably attached to the front wall 210 and/or the side wall 240, for example, by forming a weakened joint therebetween, such as via forming perforations where the top wall 230 is joined to the front wall 210 and/or the side wall 240. The quantity of the fastener holes 201 is merely exemplary and fewer or more fastener holes 201 can be provided; also, the fastening holes 201 can be formed at other locations of the second connector 200 from those shown in FIGS. 6A through 6E.

The front wall 210 has a retention tab 220 extending therefrom and a cladding alignment feature 212 protruding from a surface of the front wall 210. The cladding alignment feature 212 has a generally mushroom-shaped profile, in which a collar of the cladding alignment feature 212 that is directly attached to the front wall 210 has a smaller diameter than a distal knob of the cladding alignment feature 212 that is spaced apart from the surface of the front wall 210 by the collar of the cladding alignment feature 212. Thus, the cladding alignment feature 212 is positioned, shaped, and configured to fit within (e.g., lockingly within) eyelets or other recesses in a cladding panel for securing the cladding panel to the exterior surface of the building.

The retention tab 220 extends vertically away from (e.g., so as to be coplanar with, beyond the top wall 230) the front wall 210. In some embodiments, the retention tab 220 and the front wall 210 are formed as a unitary, or monolithic structure. As best illustrated in the detailed view of FIG. 6C, the retention tab 220 comprises one or more (e.g., a plurality of) serrations 224 formed on a surface of the retention tab 220 so as to engage with the serrations 124 of the retention clip 120 when the retention tab 220 is inserted into the gap 126 of the retention clip 120. Thus, to ensure engagement of the serrations 224 of the retention tab 220 with the serrations 124 of the retention clip 120, the serrations 224 of the retention tab 220 and the serrations 124 of the retention clip 120 extend in opposing directions. The serrations 124, 224 engage with each other to resist a relative movement of the retention tab 220 out of the gap 126 of the retention clip 120, opposite the direction of insertion.

As the retention tab 220 is inserted into the retention clip 120 (e.g., after the retention tab 220 has been inserted at least partially within the gap 126), the retention tab 220 deforms (e.g., via bending) the finger 122 of the retention clip 120, thereby widening the gap 126, at least during insertion and/or while the retention tab 220 is engaged within the retention clip 120. This deformation of the finger 122 causes the finger 222 to exert, in the direction of front wall 110, a compressive force, which presses the serrations 224 of the retention tab 220 against (e.g., to engage, or nest, within each other) the serrations 124 of the retention clip 120. This compressive force generated by the finger 122 thus resists the serrations 124, 224 from being disengaged from each other and, thus, resists disengagement of the retention tab 220 from the retention clip 120. The finger 122 is advantageously formed such that, at the entrance (e.g., the open end) of the gap 126, at least the distal end of the finger 122 remains spaced apart from (e.g., is not flush with) the surface of the retention tab 220 that the finger 122 presses against; thus, the finger 122 can be further deformed (e.g., in the direction away from the front wall 110) to allow for a controlled, or selectable, disengagement of the retention tab 220 from the retention clip 120, such as may be advantageous, for example, if the first connector 100 and the third connector 300 do not properly engage with one another to secure laterally adjacent modular units together. The engagement of the serrations 124, 224 thus resists relative vertical displacement of the modular units to which the first and second connectors 100, 200 are attached but provides only negligible (e.g., only due to friction between the serrations 124, 224) resistance against lateral displacements of the modular units to which the first and second connectors 100, 200 are attached.

In some embodiments, the retention clip 120 and the flanges 150 that form the alignment slot 160 are both formed on the side wall 140.

The side wall 240 has attached thereto (e.g., via fasteners or as a unitary, or monolithic, structure) a pair of opposing flanges 250 that, together, define an alignment slot 260. The flanges 250 have a first part that extends away from (e.g., in the direction of extension of the front wall 110) the side wall 240 and a second part that extends towards the opposing flange 250 (e.g., in the direction of extension of the side wall 240). In the example embodiment shown, the second part of the flanges 250 has a constant width over the first edge portion 252 and a tapering width over the second edge portion 254. Thus, over the entire length of the first edge portion 252, the flange 250 has a generally L-shaped cross-section and, over the entire length of the second edge portion 254, the length of the second part of the flange 250 decreases continuously in the length direction, such that only the first part of the flange 250 is present at the entrance of the alignment slot 260. In some embodiments, the width of the second part of the flange 250 is only defined by the first edge portion 252, such that each flange 250 has a substantially constant cross-sectional shape along the entire length thereof. The flanges 250 may extend the entire height of the side wall 240 of the second connector 200, or only a portion thereof.

Figure 6A:
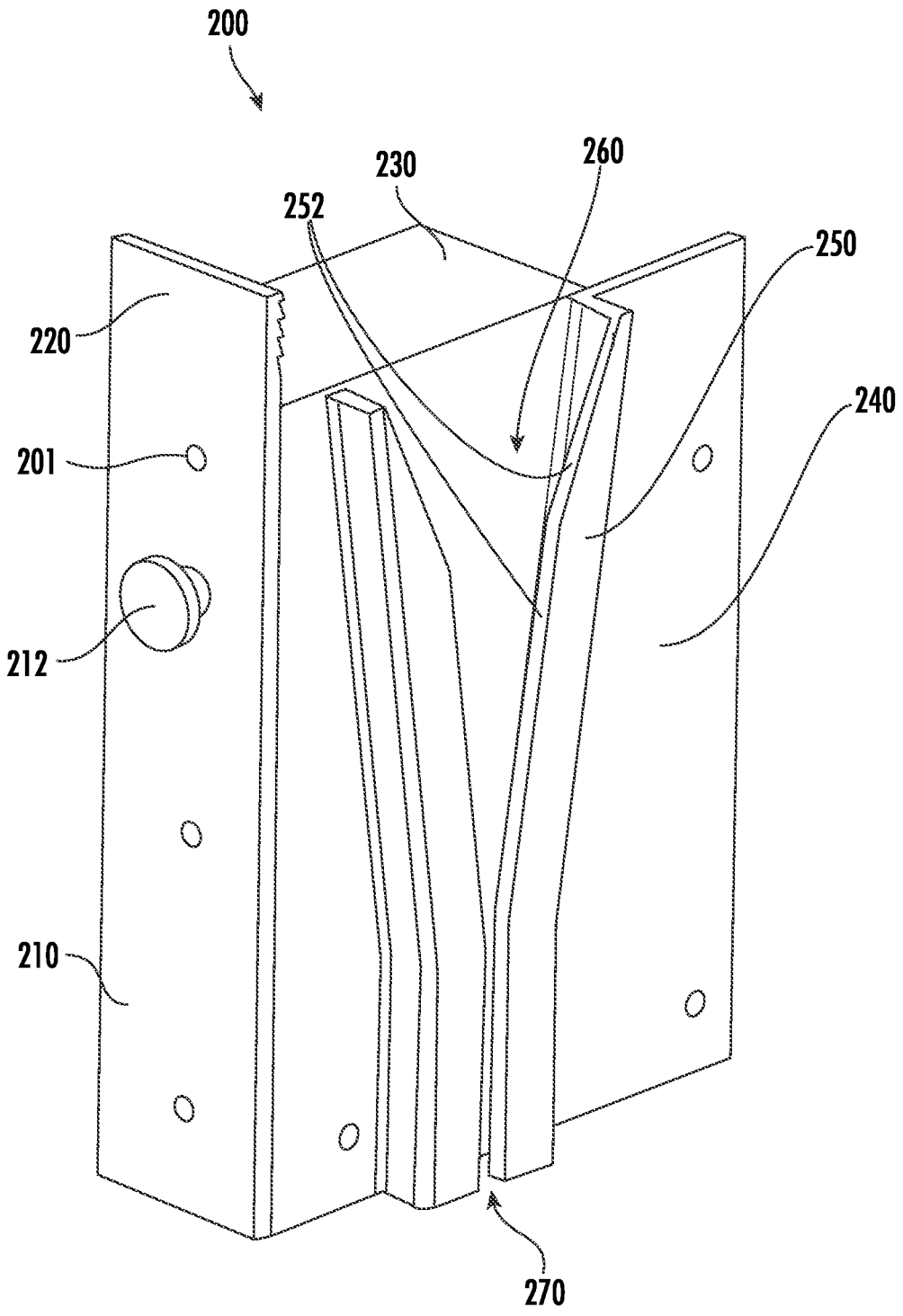
FIG. 6A is an isometric view of an example embodiment of a second connector used in the example connector system shown in FIGS. 1-4B.
Figure 6B:
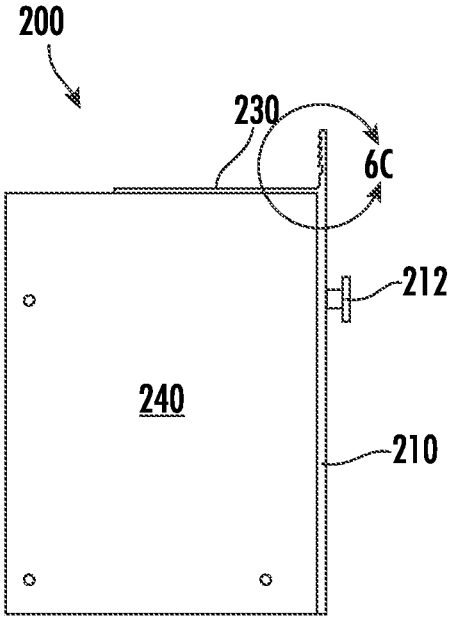
FIG. 6B is a side view of the second connector of FIG. 6A.
Figure 6C:
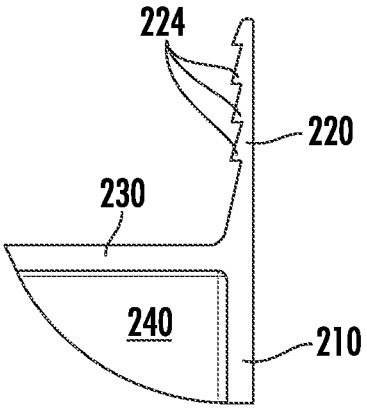
FIG. 6C is a detailed view of the portion of the second connector, as indicated in FIG. 6B.
Figure 6D:
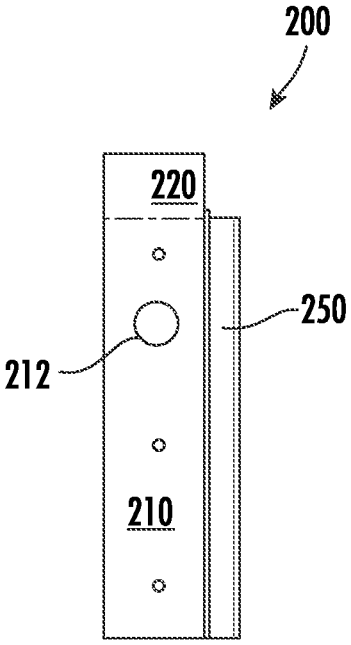
FIG. 6D is a front view of the second connector of FIG. 6A.
Figure 6E:
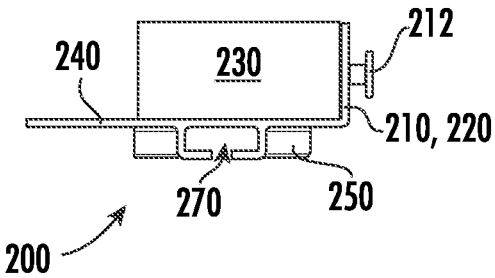
FIG. 6E is a top view of the second connector of FIG. 6A.
Figure 8A:
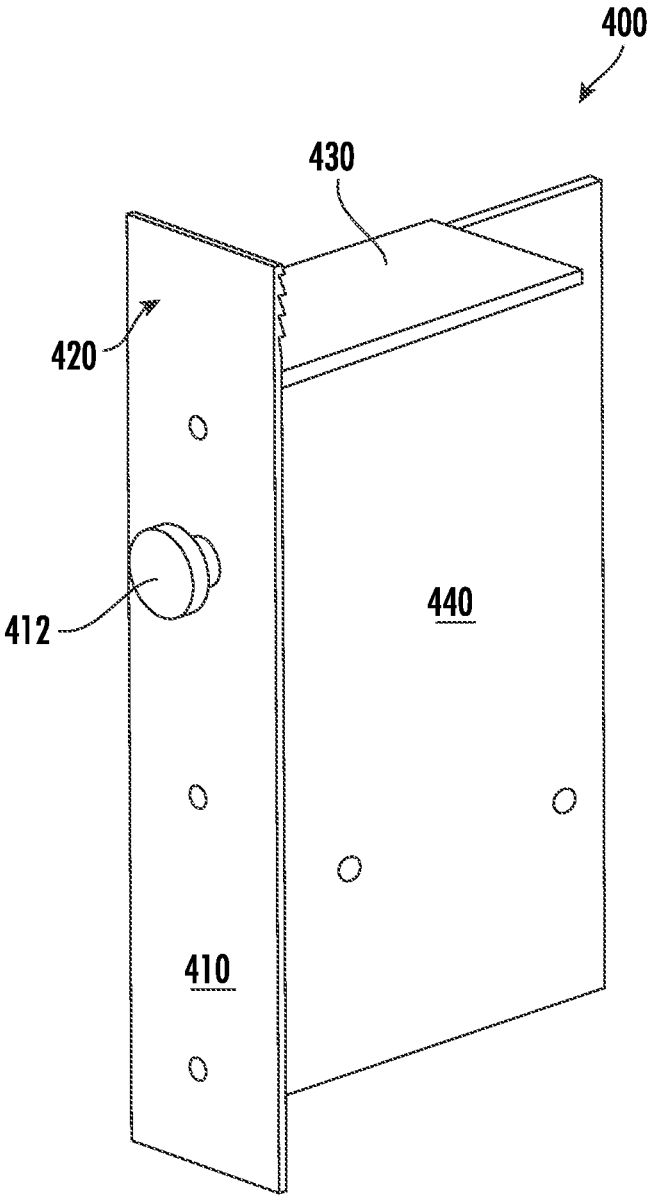
FIG. 8A is an isometric view of an example embodiment of a fourth connector used in the example connector system shown in FIGS. 1-4B.
Figure 8B:
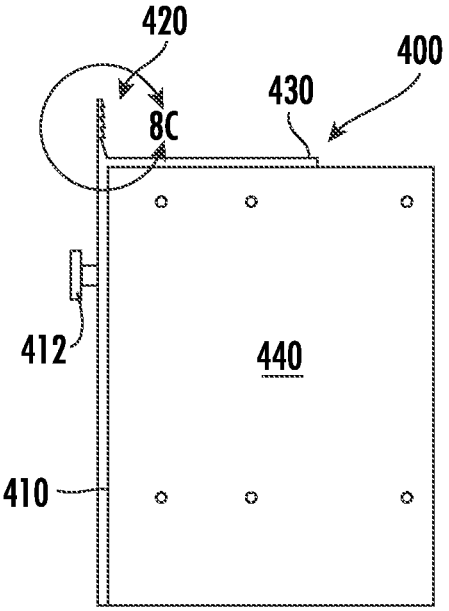
FIG. 8B is a side view of the fourth connector of FIG. 8A.
Figure 8C:
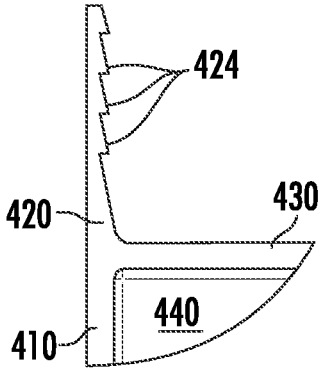
FIG. 8C is a detailed view of the portion of the fourth connector, as indicated in FIG. 8B.
Figure 8D:
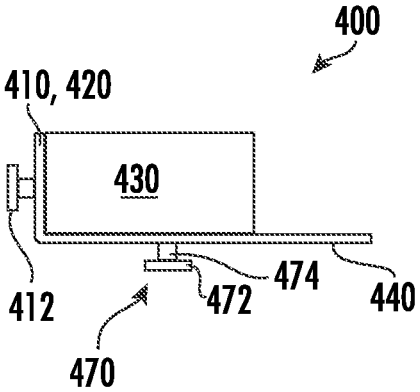
FIG. 8D is a front view of the fourth connector of FIG. 8A.
Figure 8E:
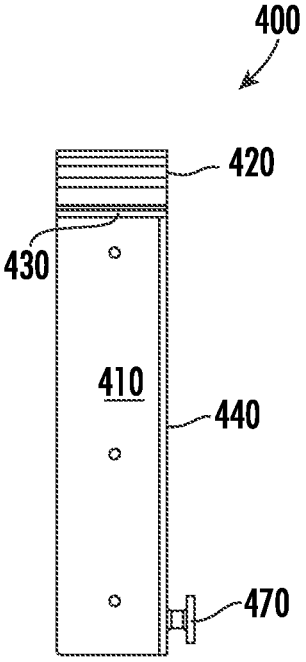
FIG. 8E is a top view of the fourth connector of FIG. 8A.

The cross-sectional area of the alignment slot 260 is thus defined by the side wall 240, the flanges 250, and the open region between the second portions of the opposing flanges 250. The flanges 250 are shaped such that, over the length of the alignment slot 260, the cross-sectional area of the alignment slot 260 decreases (e.g., continuously) as a function of length (e.g., is wider at the inlet of the alignment slot 260 and narrower at the opposing end, or outlet). Thus, the alignment slot 260 has a generally tapering shape. The flanges 250 form a channel, generally designated 270, which is continuous with the alignment slot 260, such that the outlet of the alignment slot 260 is coplanar with the inlet of the channel 270. The channel 270 has a substantially constant cross-sectional shape along the entire length thereof. The flanges 250 have a same cross-sectional shape along the entire length of the channel 270. The flanges 250 are spaced apart from each other along the entire length of the channel 270 by a distance that is greater than a diameter of the collar (see, e.g., 474, FIG. 8D) of the alignment peg (see, e.g., 470, FIG. 8D) and smaller than a diameter of the head (see, e.g., 472, FIG. 8D) of the alignment peg, such that the alignment peg can be inserted into or removed from the channel 270 only in the direction of the direction of extension of the channel 270. The flanges 250 are mirror images of each other as shown in FIG. 6A, but may be of any suitable shape and arrangement for securing an alignment peg therein.

Aspects of an example embodiment of a third connector, generally designated 300, are shown in FIGS. 7A through 7E. The third connector 300 comprises a front wall 310, which is positioned against (e.g., directly) an outer wall of the modular unit (e.g., modular unit 3, see FIG. 2) to which the third connector 300 is attached, and a side wall 340, which is positioned against (e.g., directly) a different outer wall of the modular unit to which the third connector 300 is attached. The third connector 300 is attached to the modular unit by fasteners (e.g., nails, screws, or any other suitable attachment type without limitation) that pass through the fastener holes 301 that are formed through (e.g., entirely through) the front wall 310 and the side wall 340. In some embodiments, the front wall 310 and the side wall 340 are formed (e.g., by stamping and bending) as a unitary, or monolithic, structure. In some embodiments, the entire third connector 300 can be formed as a unitary, or monolithic, structure, such as via an additive manufacturing technique (e.g., using a so-called 3D printer).

In some embodiments, one or more alignment features may be provided on the third connector 300 to ensure proper alignment of the third connector 300 at the corner of a modular unit. An example of such an alignment feature can be a tab extending orthogonally to both the front wall 310 and the side wall 340, which is held against a third side of the modular unit while the fasteners are inserted into the modular unit via the fastener holes 301 formed in the front and side walls 310, 340. In some embodiments, this tab can be removably attached to the front wall 310 and/or the side wall 340, for example, by forming a weakened joint therebetween, such as via forming perforations where the tab is joined to the front wall 310 and/or the side wall 340. The quantity of the fastener holes 301 is merely exemplary and fewer or more fastener holes 301 can be provided; also, the fastening holes 301 can be formed at other locations of the third connector 300 from those shown in FIGS. 7A through 7E.

The front wall 310 has a retention clip 320 formed thereon and a cladding alignment feature 312 protruding from a surface of the front wall 310. The cladding alignment feature 312 has a generally mushroom-shaped profile, in which a collar of the cladding alignment feature 312 that is directly attached to the front wall 310 has a smaller diameter than a distal knob of the cladding alignment feature 312 that is spaced apart from the surface of the front wall 310 by the collar of the cladding alignment feature 312. Thus, the cladding alignment feature 312 is positioned, shaped, and configured to fit within (e.g., lockingly within) eyelets or other recesses in a cladding panel for securing the cladding panel to the exterior surface of the building. The retention clip 320 has, as best illustrated in the detailed view of FIG. 5C, one or more of (e.g., a plurality of) serrations 324 that are formed in a unitary manner with the front wall 310 and a finger 322. The serrations 324 are on a surface of the retention clip 320 that is separated from the finger 322 by an insertion gap 326. The finger 322 has a generally tapering shape and/or is formed such that the inlet of the gap 326 (e.g., the end of the gap 326 that is opposite where the finger 322 is attached to the front wall 310) is wider than a midpoint and/or end of the gap 326, thereby allowing for possible slight misalignments of a retention tab (see, e.g., 420, FIG. 8C) with the retention clip 320 during insertion of the retention tab 420 into the retention clip 320.

The side wall 340 has attached thereto an alignment peg, generally designated 370. The alignment peg 370 can be attached to the side wall 340 via any suitable manner, including, for example and without limitation, brazing and/or welding. In some embodiments, the alignment peg 370 is formed as a unitary, or monolithic, structure with the side wall 340, such as via an additive manufacturing technique. The alignment peg 370 comprises a collar 374, by which the alignment peg 370 is attached to (e.g., via direct contact with) the side wall 340; thus, the collar 372 can be in direct contact with the side wall 340. The alignment peg 370 also comprises a head 372, which is attached to an opposite end of the collar 374 from where the collar 374 is attached to the side wall 340. The head 374 has a diameter that is greater than the diameter of the collar 372. In some embodiments, the diameter of the head 372 may be at least double the diameter of the collar 374. The diameter of the collar 372 is less than the distance separating the closest edges of the flanges (see, e.g., 150, FIG. 5D) in the channel (see, e.g., 170, FIG. 5D), such that the collar 374 of the alignment peg 370 can slide through the channel 170 during connection of the first and third connectors 100, 300. The length of the collar 374 in the axial direction of the alignment peg 370 is greater than the thickness of the material from which the flanges 150 are formed. The head 372 of the alignment peg 370 is greater than the distance between the flanges 150 in the channel 170, such that the alignment peg 370 can only slide within the channel 170 in the direction of extension of the channel 170. The thickness of the head 170 (e.g., in the axial direction of the alignment peg 370) is less than the thickness of the channel 170 in the same direction.

Aspects of an example embodiment of a fourth connector, generally designated 400, are shown in FIGS. 8A through 8E. The fourth connector 400 comprises a front wall 410, which is positioned against (e.g., directly) an outer wall of the modular unit (e.g., modular unit 4, see FIG. 2) to which the fourth connector 400 is attached, and a side wall 440, which is positioned against (e.g., directly) a different outer wall of the modular unit to which the fourth connector 400 is attached. The fourth connector 400 is attached to the modular unit by fasteners (e.g., nails, screws, or any other suitable attachment type without limitation) that pass through the fastener holes 401 that are formed through (e.g., entirely through) the front wall 410 and the side wall 440. The fourth connector 400 also comprises a top wall 430, which extends at an angle (e.g., orthogonally) to the front wall 410 and the side wall 440. In some embodiments, the front wall 410, the side wall 440, and the top wall 430 are all formed (e.g., by stamping and bending) as a unitary, or monolithic, structure. In some embodiments, the entire fourth connector 400 can be formed as a unitary, or monolithic, structure, such as via an additive manufacturing technique (e.g., using a so-called 3D printer).

The top wall 430 is configured as an alignment feature, such that proper alignment of the fourth connector 400 at the corner of a modular unit is ensured (e.g., by the top wall 430 resting on the top surface of the modular unit while fasteners are inserted into the modular unit via the fastener holes 401). In some embodiments, the top wall 430 can be removably attached to the front wall 410 and/or the side wall 440, for example, by forming a weakened joint therebetween, such as via forming perforations where the top wall 430 is joined to the front wall 410 and/or the side wall 440. The quantity of the fastener holes 401 is merely exemplary and fewer or more fastener holes 401 can be provided; also, the fastening holes 401 can be formed at other locations of the second connector 400 from those shown in FIGS. 8A through 8E.

The front wall 410 has a retention tab 420 extending therefrom and a cladding alignment feature 412 protruding from a surface of the front wall 410. The cladding alignment feature 412 has a generally mushroom-shaped profile, in which a collar of the cladding alignment feature 412 that is directly attached to the front wall 410 has a smaller diameter than a distal knob of the cladding alignment feature 412 that is spaced apart from the surface of the front wall 410 by the collar of the cladding alignment feature 412. Thus, the cladding alignment feature 412 is positioned, shaped, and configured to fit within (e.g., lockingly within) eyelets or other recesses in a cladding panel for securing the cladding panel to the exterior surface of the building.

The retention tab 420 extends vertically away from (e.g., so as to be coplanar with, beyond the top wall 430) the front wall 410. In some embodiments, the retention tab 420 and the front wall 410 are formed as a unitary, or monolithic structure. As best illustrated in the detailed view of FIG. 8C, the retention tab 420 comprises one or more (e.g., a plurality of) serrations 424 formed on a surface of the retention tab 420 so as to engage with the serrations 324 of the retention clip 320 when the retention tab 420 is inserted into the gap 326 of the retention clip 320. Thus, to ensure engagement of the serrations 424 of the retention tab 420 with the serrations 324 of the retention clip 320, the serrations 424 of the retention tab 420 and the serrations 324 of the retention clip 320 extend in opposing directions. The serrations 324, 424 engage with each other to resist a relative movement of the retention tab 420 out of the gap 326 of the retention clip 320, opposite the direction of insertion.

As the retention tab 420 is inserted into the retention clip 320 (e.g., after the retention tab 420 has been inserted at least partially within the gap 326), the retention tab 420 deforms (e.g., via bending) the finger 322 of the retention clip 320, thereby widening the gap 326, at least during insertion and/or while the retention tab 420 is engaged within the retention clip 320. This deformation of the finger 322 causes the finger 322 to exert, in the direction of front wall 310, a compressive force, which presses the serrations 424 of the retention tab 420 against (e.g., to engage, or nest, within each other) the serrations 324 of the retention clip 320. This compressive force generated by the finger 322 thus resists the serrations 324, 424 from being disengaged from each other and, thus, resists disengagement of the retention tab 420 from the retention clip 320. The finger 322 is advantageously formed such that, at the entrance (e.g., the open end) of the gap 326, at least the distal end of the finger 322 remains spaced apart from (e.g., is not flush with) the surface of the retention tab 420 that the finger 322 presses against; thus, the finger 322 can be further deformed (e.g., in the direction away from the front wall 310) to allow for a controlled, or selectable, disengagement of the retention tab 420 from the retention clip 320, such as may be advantageous, for example, if the first connector 100 and the third connector 300 do not properly engage with one another to secure laterally adjacent modular units together. The engagement of the serrations 324, 424 thus resists relative vertical displacement of the modular units to which the third and fourth connectors 300, 400 are attached but provides only negligible (e.g., only due to friction between the serrations 324, 424) resistance against lateral displacements of the modular units to which the third and fourth connectors 300, 400 are attached.

The side wall 440 has attached thereto an alignment peg, generally designated 470. The alignment peg 470 can be attached to the side wall 440 via any suitable manner, including, for example and without limitation, brazing and/or welding. In some embodiments, the alignment peg 470 is formed as a unitary, or monolithic, structure with the side wall 440, such as via an additive manufacturing technique. The alignment peg 470 comprises a collar 474, by which the alignment peg 470 is attached to (e.g., via direct contact with) the side wall 440; thus, the collar 472 can be in direct contact with the side wall 440. The alignment peg 470 also comprises a head 472, which is attached to an opposite end of the collar 474 from where the collar 474 is attached to the side wall 440. The head 474 has a diameter that is greater than the diameter of the collar 472. In some embodiments, the diameter of the head 472 may be at least double the diameter of the collar 474. The diameter of the collar 472 is less than the distance between the flanges (see, e.g., 250, FIG. 6A) in the channel (see, e.g., 270, FIG. 6A), such that the collar 474 of the alignment peg 470 can slide through the channel 270 during connection of the second and fourth connectors 200, 400. The length of the collar 474 in the axial direction of the alignment peg 470 is greater than the thickness of the material from which the flanges 250 are formed. The head 472 of the alignment peg 470 is greater than the distance separating the closest edges of the flanges 250 in the channel 270, such that the alignment peg 470 can only slide within the channel 270 in the direction of extension of the channel 270. The thickness of the head 470 (e.g., in the axial direction of the alignment peg 470) is less than the thickness of the channel 270 in the same direction.

In assembling the connector system 10, the second modular unit 2 with the second connector 200 attached thereto is installed (e.g., securely and/or rigidly) at a designated position within the building (e.g., by attaching other connectors at other corners and/or edges of the second modular unit 2 to connectors that are attached to other modular units that have already been installed within the building).

Next, the fourth modular unit 4 with the fourth connector 400 attached thereto is positioned such that the fourth connector 400 securely engages with the second connector 200. During engagement of the fourth connector 400 with the second connector 200, the fourth modular unit 4 is positioned laterally adjacent to the second modular unit 2, at a position such that the head 472 of the alignment peg 470 is positioned within the volumetric region defined for the alignment slot 260 by the frames 250. In some embodiments, it is advantageous for the alignment peg 470 to have a length that is greater than the height of the flanges 250 (e.g., as measured orthogonal to the side wall 240), such that the head 472 of the alignment peg 470 can be positioned in direct contact with the side wall 240 within the alignment slot 260. The fourth modular unit 4 is then lowered substantially vertically, relative to the second modular unit 2, such that the head 472 of the alignment peg 470 remains within the alignment slot 260 as the fourth modular unit 4 is lowered into position. The tapered shape of the alignment slot 260 (e.g., by the bent shape of the opposing frames 250) is advantageous because, as the fourth modular unit 4 is lowered vertically relative to the second modular unit 2, the cross-sectional width of the alignment slot 260 decreases progressively (e.g., continuously), such that progressive alignment of the alignment peg 470 with the channel 270 is ensured. Stated differently, the tapering shape of the alignment slot 260 acts as a funnel for directing the alignment peg 470 towards the channel 270 as the fourth modular unit 4 is progressively lowered beside the second modular unit 2.

After the fourth modular unit 4 has been lowered by a sufficient distance such that the alignment peg 470, while remaining within the alignment slot 260, is at the entrance to the channel 270, the fourth modular unit 4 continues to be lowered relative to the second modular unit, but relative lateral movements of the second and fourth modular units 2, 4 is resisted and/or prevented. Thus, once the alignment peg 470 enters the channel 270, the second and fourth modular units 2, 4 cannot be moved laterally relative to each other, except for gaps that are required to allow for proper engagement of the second and fourth connectors 200, 400. The fourth modular unit 4 continues to be lowered relative to the second modular unit 2 until the fourth modular unit 4 is in its designated position within the building and, preferably, the head 472 of the alignment peg 470 is positioned within the channel 270. It is advantageous for the alignment peg 470 to be attached to the side wall 440 at a position such that, when the fourth modular unit 4 is installed in its designated position within the building, the alignment peg 470 is positioned at a midpoint of the channel (e.g., as measured in the direction of movement of the alignment peg 470 within the channel 270 during installation). The alignment peg 470 and the channel 270 are formed with sufficient precision and the fourth connector 400 and the second connector 200 are connected to the fourth and second modular units 4, 2, respectively, with sufficient precision that proper alignment of the second and fourth modular units 2, 4 is ensured.

After the fourth connector 400 is fully engaged with the second connector 200 to resist lateral movement therebetween, the first modular unit 1, with the first connector 100 attached thereto, is positioned vertically above the second modular unit 2. Thus, the first connector 100 is vertically above (e.g., directly) the second connector 200, such that the retention clip 120 is vertically aligned with the retention tab 220. It is advantageous for the first modular unit 1 to be positioned relative to the second modular unit 2 such that the retention clip 120 and the retention tab 220 are substantially coaxial (e.g., aligned such that at least 50% of the width of the retention tab 220 will engage within the retention clip 120) with each other. Connectors on other corners of the first modular unit 1 engaging with connectors on other modular units can also be used to aid in proper alignment of the first modular unit 1 with the second modular unit 2. Once properly aligned, the first modular unit 1 is lowered vertically onto the second modular unit 2, such that the retention tab 220 is at least partially inserted within the gap 126 of the retention clip 120. In some embodiments, the first modular unit 1 is vertically lowered until the first modular unit 1 is in contact (e.g., direct contact) with the second modular unit 2, such that the weight of the first modular unit 1 is not transferred into the second modular unit via the engagement of the retention tab 220 within the retention clip 120.

The retention tab 220 is progressively engaged within the retention clip 120 simultaneously with the first modular unit 1 being lowered vertically onto the second modular unit 2. Thus, as the first modular unit 1 is lowered vertically onto the second modular unit 2, the finger 122 of the retention clip 120 is deformed (e.g., in deformation, preferably in elastic deformation) by being pushed away from the serrations 124 of the retention clip 120 as the serrations 224 of the retention tab 220 slide over the serrations 124 of the retention clip 120 during insertion of the retention tab 220 into the gap 126 of the retention clip 120. It is advantageous for the retention tab 220 to be inserted within the retention clip 120 by a sufficient distance that all of the serrations 124 of the retention clip 120 are engaged in an interlocking manner with a corresponding serration 224 of the retention tab 220. The deformation of the finger 122 causes an exertion of a compressive force in the direction of the serrations 124 such that the serrations 224 of the retention tab 220 are pressed against, and interlocked with, the serrations 124 of the retention clip 120.

The quantity of serrations 124 of the retention clip 120 that need to be engaged with serrations 224 of the retention tab 220 can be selected based on a particular application. The compressive force exerted by the finger 122 resists the serrations 124, 224 from being dislodged from their engaged and/or interlocked positions after insertion of the retention tab 220 within the retention clip 120, such as may otherwise be induced by vertically-oriented loads that would cause relative vertical displacement of the first and second modular units 1, 2 in the absence of this compressive force that interlocks the serrations 124, 224 together.

After the first connector 100 is fully engaged with the second connector 200, the third modular unit 3, with the third modular connector 300 attached thereto, is positioned vertically above the fourth modular unit 4 and laterally next to the first modular unit 1. In this position, the third connector 300 is vertically above (e.g., directly) the fourth connector 400, such that the retention clip 320 is vertically aligned with the retention tab 420, and the head 372 of the alignment peg 370 of the third connector 300 is positioned within the volumetric region defined for the alignment slot 160 by the frames 150. It is advantageous for the third modular unit 3 to be positioned relative to the fourth modular unit 4 such that the retention clip 320 and the retention tab 420 are substantially coaxial (e.g., aligned such that at least 50% of the width of the retention tab 420 will engage within the retention clip 320) with each other.

In some embodiments, it is advantageous for the alignment peg 370 to have a length that is greater than the height of the flanges 150 (e.g., as measured orthogonal to the side wall 140), such that the head 372 of the alignment peg 370 can be positioned in direct contact with the side wall 140 within the alignment slot 160. The third modular unit 3 is then lowered substantially vertically, relative to the first modular unit 1, such that the head 372 of the alignment peg 370 remains within the alignment slot 160 as the third modular unit 3 is lowered into position. The tapered shape of the alignment slot 260 (e.g., by the bent shape of the opposing frames 150) is advantageous because, as the third modular unit 3 is lowered vertically relative to the first modular unit 1, the cross-sectional width of the alignment slot 160 decreases progressively (e.g., continuously), such that progressive alignment of the alignment peg 370 with the channel 170 is ensured. Stated differently, the tapering shape of the alignment slot 160 acts as a funnel for directing the alignment peg 370 towards the channel 170 as the third modular unit 3 is progressively lowered beside the first modular unit 1 and over the fourth modular unit 4. It is advantageous for the alignment peg 370 and the channel 170 to be formed such that the retention tab 420 only begins to engage with the retention clip 320 after the collar 374 of the alignment peg 370 has entered (e.g., is positioned within) the channel 170; thus, no portion of the retention tab 420 is in the gap 326 of the retention clip 320 until the alignment peg 370 is engaged within the channel 170.

The retention tab 420 is progressively engaged within the retention clip 320 simultaneously with the third modular unit 3 being lowered vertically onto the fourth modular unit 4. Thus, as the third modular unit 3 is lowered vertically onto the fourth modular unit 4, the finger 322 of the retention clip 320 is deformed (e.g., in deformation, preferably in elastic deformation) by being pushed away from the serrations 324 of the retention clip 320 as the serrations 424 of the retention tab 420 slide over the serrations 324 of the retention clip 320 during insertion of the retention tab 420 into the gap 326 of the retention clip 320. It is advantageous for the retention tab 420 to be inserted within the retention clip 320 by a sufficient distance that all of the serrations 324 of the retention clip 320 are engaged in an interlocking manner with a corresponding serration 424 of the retention tab 420. The deformation of the finger 322 causes an exertion of a compressive force in the direction of the serrations 324 such that the serrations 424 of the retention tab 420 are pressed against, and interlocked with, the serrations 324 of the retention clip 320.

The quantity of serrations 324 of the retention clip 320 that need to be engaged with serrations 424 of the retention tab 420 can be selected based on a particular application. The compressive force exerted by the finger 322 resists the serrations 324, 424 from being dislodged from their engaged and/or interlocked positions after insertion of the retention tab 420 within the retention clip 320, such as may otherwise be induced by vertically-oriented loads that would cause relative vertical displacement of the third and fourth modular units 3, 4 in the absence of this compressive force that interlocks the serrations 324, 424 together.

In some embodiments, the engagement of the retention tab 420 with the retention clip 320 and the engagement of the alignment peg 370 and the channel 170 is substantially simultaneous. In such embodiments, the progressive alignment of the alignment peg 370 with the channel 170 due to the funnel-shape of the alignment slot 160 and the substantially rigid construction of the first, second, third, and fourth connectors 100, 200, 300, 400 causes the retention clip 320 to become simultaneously progressively aligned with the retention tab 420 as the alignment peg 370 is progressively aligned with the channel 170.

In some embodiments, the engagement of the retention tab 420 with the retention clip 320 and the engagement of the alignment peg 370 and the channel 170 is staggered, such that the alignment peg 370 engages within the channel 170 prior to the engagement of the engagement of the retention tab 420 with the retention clip 320. This can be, in some instances, advantageous by allowing for evaluation of the alignment of the retention tab 420 and the retention clip 320 for all connectors attached to, for example, the third and fourth modular units 3, 4, before the third modular unit 3 is lowered vertically to engage the retention tab 420 within the retention clip 320. This alignment pre-evaluation can prevent the need to disengage some retention tabs/clips from each other due to misalignment of at least one retention tab/clip that resulted in non-engagement thereof.

After the third connector 300 is fully engaged with both the first connector 100 and the fourth connector 400, the connector system is fully assembled and each of the first, second, third, and fourth connectors 100, 200, 300, 400 are rigidly interlocked with each other.

In some embodiments, all modular units that are on the same story, or level, of the building as the second and fourth modular units 2, 4 are installed prior to installation of the first and third modular units 1, 3 and, thus necessarily, before the first and third connectors 100, 300 are interconnected with the second and fourth connectors 200, 400.

When the connector system 10 is assembled, the first, second, and third connectors 100, 200, 300 are directly attached to each other and the second, third, and fourth connectors 200, 300, 400 are directly attached to each other. Thus, the first and fourth connectors 100, 400 are not directly connected to each other but are only connected to each other indirectly, via connections to the second and third connectors 200, 300. Similarly, the second and third connectors 200, 300 are not directly connected to each other but are only connected to each other indirectly, via connections to the first and fourth connectors 100, 400.

The length of the channel 170 is sufficiently great that the alignment peg 370 of the third connector 300 is positioned within the channel before the retention tab 220 begins to engage within the retention clip 120. By virtue of the alignment peg 370 being held within the channel 170, it can be ensured that the retention tab 220 and the retention clip 120 are sufficiently aligned to prevent misalignments thereof that may lead to bending, distortion, and/or other damage to the retention tab 220 and/or the retention clip 120.

The flanges 150, 250 can be, in some embodiments, flipped vertically about a midpoint plane (e.g., coaxial with the direction of extension of the channel 170, 270) and the alignment peg 370, 470 can be moved to a mirror position about the midpoint line, such that the alignment slot 160 of the first connector 100 can be inserted over the alignment peg 370 of the third connector 300.

The length of the channel 170 is sufficiently great that the alignment peg 370 of the third connector 300 is positioned within the channel before the retention tab 220 begins to engage within the retention clip 120. By virtue of the alignment peg 370 being held within the channel 170, it can be ensured that the retention tab 220 and the retention clip 120 are sufficiently aligned to prevent misalignments thereof that may lead to bending, distortion, and/or other damage to the retention tab 220 and/or the retention clip 120.

The flanges 150 can be, in some embodiments, flipped vertically about a midpoint line and the alignment peg 370 can be moved to a mirror position about the midpoint line, such that the alignment slot 160 of the first connector 100 can be inserted over the alignment peg 370 of the third connector 300.

Laterally adjacent modular units (e.g., the first and third modular units 1, 3 and the second and fourth modular units 2, 4) are attached by sliding an alignment peg (see, e.g., 370, 470, FIG. 3) within an alignment slot 150, 250 and vertically adjacent modular units (e.g., the first and second modular units 1, 2 and the third and fourth modular units 3, 4) are attached by inserting a retention tab 220, 420 within a retention clip 120, 320, with serrations 124, 324 being formed on a wall of each of the first and third connectors 100, 300 having the retention clip 120, 320 and serrations 224, 424 being formed on a surface of the retention tab 220, 420 in a position that will face the serrations 124, 324 on the wall of the retention clip 120, 320 into which the retention tab 220, 420 is to be inserted. The serrations 124, 324 of the retention clip 120, 320 and the serrations 224, 424 on the retention tab 220, 420 are shaped complementarily, such that the serrations 224, 424 of the retention tab 220, 420 interlock with the serrations 124, 324 of the retention clip 120, 320, with the retention clip 120, 320 applying a compressive force to press the serrations 224, 424 of the retention tab 120, 320 against and between the serrations 124, 324 of the retention clip 120, 320 to prevent separation of the vertically connected first and second connectors 100, 200 and third and fourth connectors 300, 400 unless the retention clip 120, 320 is disengaged from the retention tab 220, 420.

As shown, each of the first, second, third, and fourth connectors 100, 200, 300, 400 are connectable to at least two other adjacent connectors, preferably connectors that are arranged orthogonal to each other (e.g., one connector that is vertically aligned and another connector that is laterally aligned). The second and fourth connectors 200, 400 have a top wall 230, 430 that rests on the upper surface of the modular unit 2, 4 to which the second and fourth connectors 200, 400, are respectively affixed to aid in proper positioning of the second and fourth connectors 200, 400 on the respective second and fourth modular units 2, 4. Each of the first, second, third, and fourth connectors 100, 200, 300, 400 have a side wall 140, 240, 340, 440 and a front wall 110, 210, 310, 410, each of which has fastener holes 101, 201, 301, 401 formed therethrough to allow for fastening of each of the first, second, third, or fourth connector 100, 200, 300, 400 to its respective modular unit 1, 2, 3, 4.

In the example embodiment shown, each of the first and second connectors 100, 200 have an alignment slot 160, 260 and channel 170, 270, which are rigidly attached to a side wall 140, 240 thereof, adjacent to a side wall 340, 440 of the respective third and fourth connectors 300, 400, on which is rigidly provided an alignment tab 370, 470 that is configured to be accommodated within the alignment slot 160, 260 and channel 170, 270. The alignment slot 160, 260 has a generally tapered shape, in which inlet to the alignment slot 160, 260 is wider and the width of the alignment slot 160, 260 decreases (e.g., stepwise or continuously) to the channel 170, 270, which has a width that is substantially similar to (e.g., wider than) the collar 374, 474 of the alignment peg 370, 470. As such, as the alignment peg 370, 470 of one of the third or fourth connectors 300, 400 is progressively engaged within the alignment slot 160, 260, respectively, due to the tapering shape of the alignment slot 160, 260, laterally adjacent connectors (e.g., 100, 300 and 200, 400) are brought into alignment with each other. The alignment peg 370, 470 has a circular protrusion, or head 373, 472, that is wider than the collar 374, 474, which is retained within the alignment slot 160, 260 due to the flanges 150, 250 that form the alignment slot 160, 260.

In the example embodiment shown, each of the first and third connectors 100, 300 have a retention clip 120, 320, which has a finger 122, 322 positioned over and adjacent to serrations 124, 324 formed in a respective wall (e.g., the front wall 110, 310) thereof, while the second and fourth connectors 200, 400 have a retention tab 220, 420 extending vertically away from the front wall 210, 410 (e.g., coplanar to the front wall 210, 410, away from the modular unit to which the second or fourth connector 200, 400 is affixed), with serrations 224, 424 formed on the surface of the retention tab 220, 420 adjacent to the top of the respective second or fourth connector 200, 400. As the retention tab 220, 420 of the second or fourth connector 200, 400 is inserted in the gap 126, 326 formed within the retention clip 120, 320, the finger 122, 322 of the retention clip 120, 320 presses the serrations 224, 424 of the retention tab 220, 420 against the serrations 124, 324 of the retention clip 120, 320 for interlocking. The weight of the first and third modular units 1, 3 being positioned vertically over the already installed second and fourth modular units 2, 4, respectively, aids in engaging the retention tab 220, 420 within the gap 126, 326 formed within the retention clip 120, 320. Thus, by virtue of the alignment peg 370, 470 being progressively aligned within the channel 170, 270 via the alignment slot 160, 260 as laterally adjacent modular units are positioned next to each other (e.g., move vertically relative to each other), the retention tab 220, 420 and the gap 126, 326 of the corresponding retention clip 120, 320 are automatically aligned to lock the modular units 1, 2, 3, 4 in a substantially static configuration (e.g., allowing for relative movements based on, for example, thermal expansion or contraction, seismic activity, wind, and the like), as the connector system 10 resists both vertical loads, or forces (e.g., "uplift"), and lateral loads, or forces.

As such, the alignment peg 370, 470 and the alignment slot 160, 260 and channel 170, 270 of laterally adjacent modular units interlock with each other to prevent laterally adjacent modular units from being separated while the alignment peg 370, 470 is inserted within the channel 170, 270 formed at the terminal end of the alignment slot 160, 260. Similarly, as the alignment peg 370, 470 enters the channel 170, 270, which is generally vertically oriented, the retention tab 220, 420 begins to be inserted within the gap 126, 326 of the retention clip 120, 320 of vertically adjacent modular units. Therefore, when the alignment peg 370, 470 is within the channel 170, 270, the laterally adjacent modular units are aligned (e.g., in the front-to-back direction), thereby ensuring that the retention tab 220, 420 is aligned for insertion within the gap 126, 326 of a corresponding one of the retention clips 120, 320. Therefore, by the interlocking engagement of the serrations 224, 424 of the retention tab 220, 420 with the serrations 124, 324 of the retention clip 120, 320, vertically adjacent modular units can be connected together and retained together. Thus, the connector system 10 is configured to interlock laterally adjacent and vertically adjacent modular units within a building and also to resist forces that would act to cause a separation of the interlocked laterally and/or vertically adjacent modular units. The positioning of the retention tabs 220, 420 and the retention clips 120, 320 may be reversed from the example shown herein, such that the first and/or third connectors 100, 300 may have retention tabs and the second and/or fourth connectors 200, 400 may have retention clips. Similarly, the positioning of the alignment pegs 370, 470 and the alignment slots 160, 260 and channels 170, 270 may be reversed from the example shown herein, such that the first and/or second connectors 100, 200 may have alignment pegs and the third and/or fourth connectors 300, 400 may have frames that define an alignment slot and channel.

Each of the first, second, third, and fourth connectors 100, 200, 300, 400 further has one or more (e.g., one or a plurality of) cladding alignment features 112, 212, 312, 412 in the form of a collar with a radial protrusion at the end thereof extending from the respective front wall 110, 210, 310, 410. Each cladding alignment feature 112, 212, 312, 412 is rigidly attached to the front wall 110, 210, 310, 410 and is positioned on the front wall 110, 210, 310, 410 in a position where a corresponding receiver is positioned on a cladding member or panel, into which the cladding alignment feature 112, 212, 312, 412 can be slidingly inserted for retention of the cladding member or panel onto and covering, in whole or in part, the first, second, third, or fourth connector 100, 200, 300, 400 to which it is connected and/or one or more modular units 1, 2, 3, 4.

Figure 3:
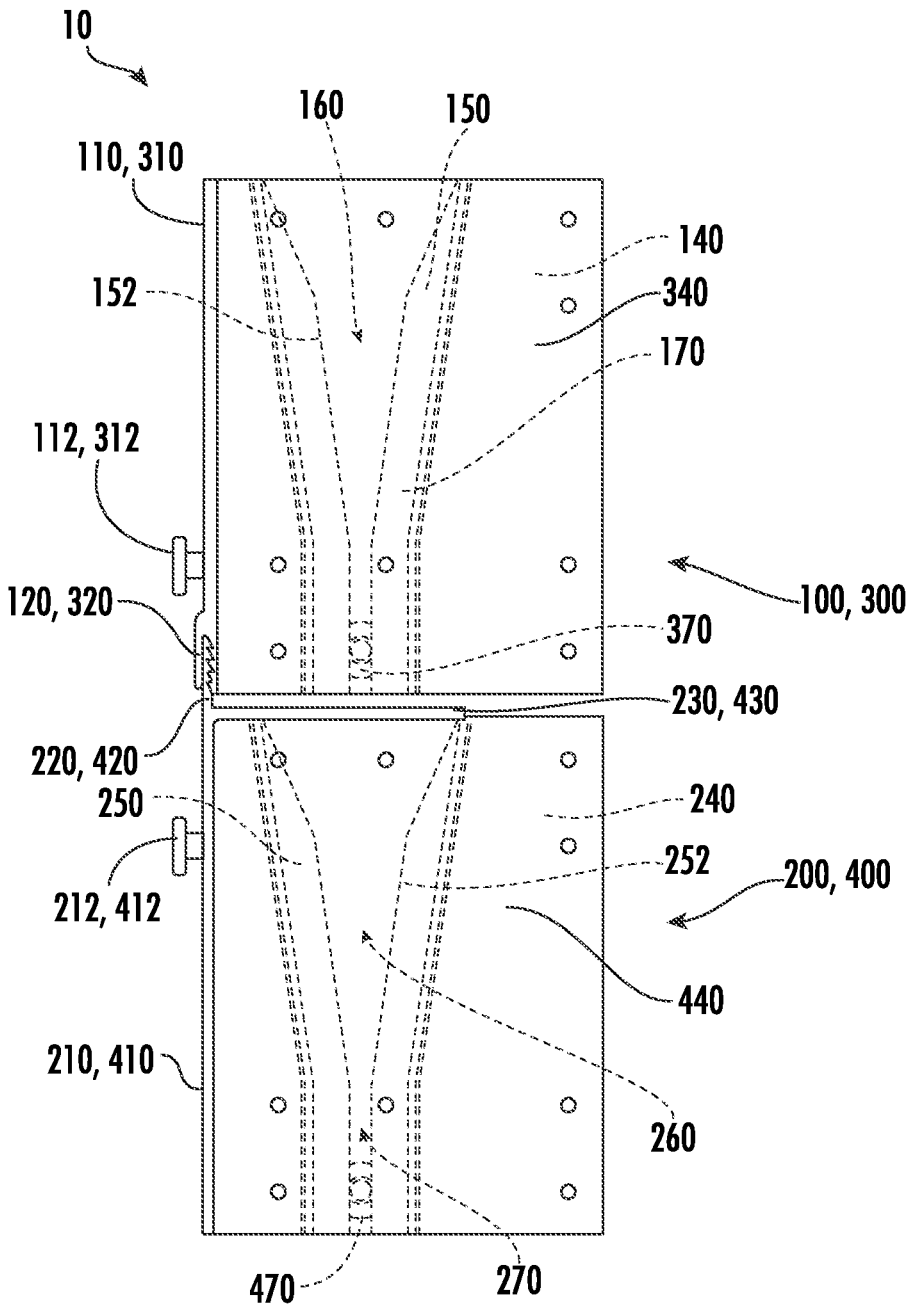
FIG. 3 is a side view of the example connector system of FIG. 1.
Figure 4A:
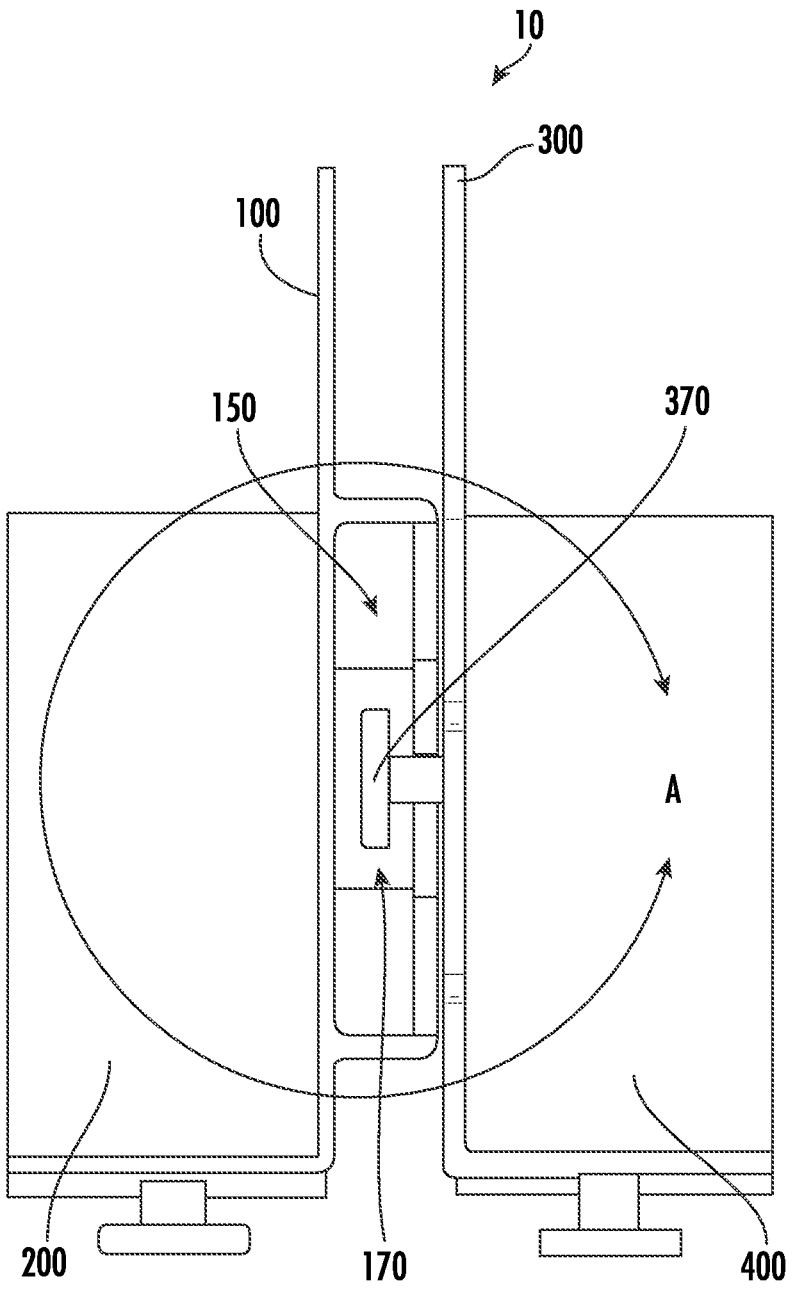
FIG. 4A is top view of the example connector system of FIG. 1.
Figure 4B:
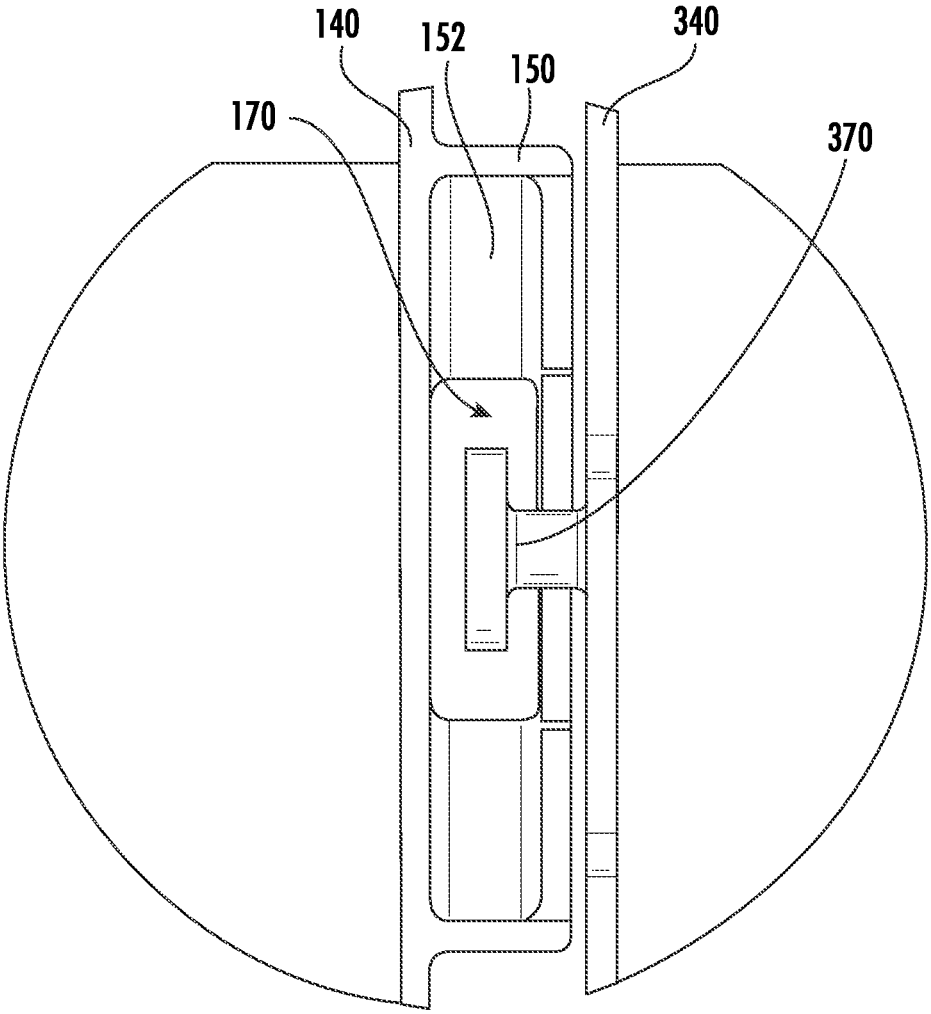
FIG. 4B is a detailed view of the example connector system shown in FIG. 4A.

In addition to the first, second, third, and fourth connectors 100, 200, 300, 400, which are of a type configured for placement and attachment at intersecting corners of laterally adjacent and/or vertically adjacent modular units, the connector system 10 can also comprise one or more strap connectors, generally designated 500, 600, as shown in FIGS. 9A through 10D. These strap connectors 500, 600 are configured to be positioned along the top or bottom edges of vertically adjacent modular units to provide additional resistance of the connector system 10 against vertical loads that would otherwise cause separation of such vertically-adjacent modular units. Additionally, the connector system 10 is configured such that the fifth and sixth connectors 500, 600 can be positioned on a vertically adjacent modular unit to interact with any of the first, second, third, or fourth connectors 100, 200, 300, 400. For example, in some embodiments, all of the modular units may not have a same width, such that the corners of modular units are not adjacent to each other, as shown in FIGS. 1-3, but instead two upper modular units are installed at a position along the width of a lower modular unit (e.g., between corners thereof). In such an embodiment, the two sixth connectors 600 may be provided along the upper edge of the lower modular unit, in a position such that each sixth connector 600 will engage with the retention clip 120, 320 of one of the first and third connectors 100, 300. A similar instance may occur where an upper modular unit is installed over two lower modular units at a position along the width of the two lower modular units where the adjacent corners of the two lower modular units are not adjacent to a corner of the upper modular units. In such an embodiment, the two fifth connectors 500 may be provided along the lower edge of the upper modular unit, in a position such that each fifth connector 500 will engage with the retention tab 220, 420 of one of the second and fourth connectors 200, 400. Further aspects of the fifth and sixth connectors 500, 600 will be described further hereinbelow.

The fifth connectors 500, example embodiments of which are shown in FIGS. 9A through 9D, have substantially similar features of the first and third connectors 100, 300, if the side walls 140, 340 thereof and the structures attached to the side walls 140, 340 were omitted and only the structures that are attached (e.g., directly, especially those formed in a unitary manner) to the front walls 110, 310 are included. Thus, each fifth connector 500 has a front wall 510, which has a retention clip 520 formed thereon and a cladding alignment feature 512 protruding from a surface of the front wall 510. The front wall 510 has a plurality of fastener holes 501 formed through the entire thickness thereof, such that the fifth connector 500 can be rigidly attached to a designated structure of a modular unit (e.g., any of the first, second, third, or fourth modular units 1, 2, 3, 4) via insertion of fasteners (e.g., nails, screws, or any other suitable attachment type without limitation) through the fastener holes 501 and into the modular unit. In some embodiments, the front wall 510 and the retention clip 520 are formed (e.g., by extrusion or any other suitable technique) as a unitary, or monolithic, structure. In some embodiments, the entire fifth connector 500 can be formed as a unitary, or monolithic, structure, such as via an additive manufacturing technique (e.g., using a so-called 3D printer). The quantity of the fastener holes 501 is merely exemplary and fewer or more fastener holes 501 can be provided; also, the fastening holes 501 can be formed at other locations of the fifth connector 500 from those shown in FIGS. 9A through 9D.

The cladding alignment feature 512 has a generally mushroom-shaped profile, in which a collar of the cladding alignment feature 512 that is directly attached to the front wall 510 has a smaller diameter than a distal knob of the cladding alignment feature 512 that is spaced apart from the surface of the front wall 510 by the collar of the cladding alignment feature 512. Thus, the cladding alignment feature 512 is positioned, shaped, and configured to fit within (e.g., lockingly within) eyelets or other recesses in a cladding panel for securing the cladding panel to the exterior surface of the building.

Figure 9A:
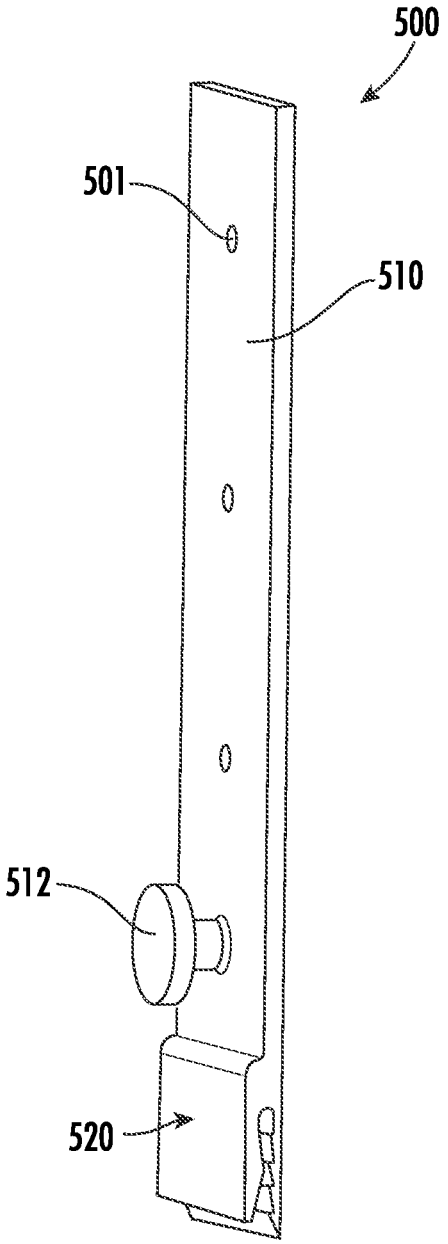
FIG. 9A is an isometric view of an example embodiment of a fifth connector for use in a further example embodiment of a connector system.
Figure 9B:
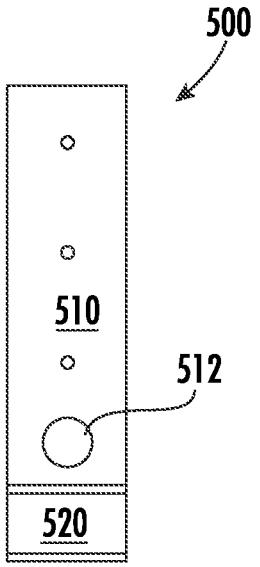
FIG. 9B is a front view of the fifth connector of FIG. 9A.
Figure 9C:
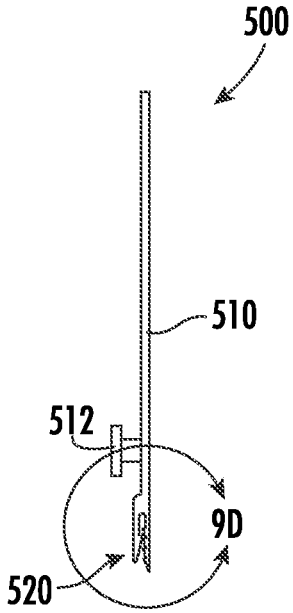
FIG. 9C is a side view of the fifth connector of FIG. 9A.
Figure 9D:
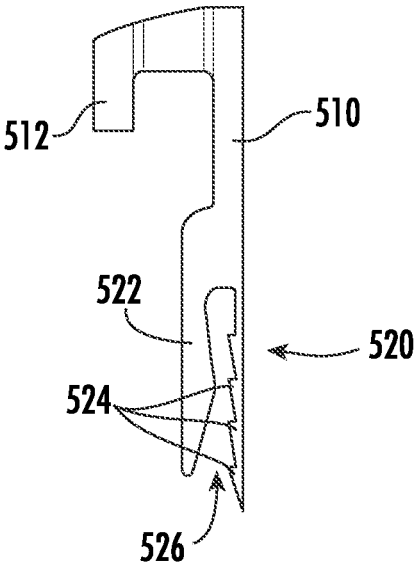
FIG. 9D is a detailed view of the portion of the fifth connector, as indicated in FIG. 9C.

The retention clip 520 has, as best illustrated in the detailed view of FIG. 9D, one or more of (e.g., a plurality of) serrations 524 that are formed in a unitary manner with the front wall 510 and a finger 522. The serrations 524 are on a surface of the retention clip 520 that is separated from the finger 522 by an insertion gap 526. The finger 522 has a generally tapering shape and/or is formed such that the inlet of the gap 526 (e.g., the end of the gap 526 that is opposite where the finger 522 is attached to the front wall 510) is wider than a midpoint and/or end of the gap 526, thereby allowing for possible slight misalignments of a retention tab (see, e.g., 620, FIG. 10D) with the retention clip 520 during insertion of the retention tab 620 into the retention clip 520. As noted elsewhere, the retention clip 520 is advantageously configured to be able to engage with the any of the retention tabs 220, 420, 620 of the second, fourth, and/or sixth connectors 200, 400, 600 and is substantially similar, both in form and function, to the retention clips 120, 320 of the first and third connectors 100, 300.

The sixth connectors 600, example embodiments of which are shown in FIGS. 10A through 10D, have substantially similar features of the second and fourth connectors 200, 400, if the side walls 240, 440 thereof and the structures attached to the side walls 240, 440 were omitted and only the structures that are attached (e.g., directly, especially those formed in a unitary manner) to the front walls 210, 410 are included. Thus, each sixth connector 600 has a front wall 610, which has a retention tab 620 formed thereon (e.g., in a unitary, or monolithic, manner) and a cladding alignment feature 612 protruding from a surface of the front wall 610. The sixth connector 600 has a top wall 630 attached to the front wall 610 at a position at or below where the retention tab 620 extends from the front wall 610. In some embodiments, the intersection of the front wall 610 and the top wall 630 defines the dimensions of the retention tab 620, such that only the retention tab 620 extends beyond the intersection of the front wall 610 and the top wall 630.

The front wall 610 has a plurality of fastener holes 601 formed through the entire thickness thereof, such that the sixth connector 600 can be rigidly attached to a designated structure of a modular unit (e.g., any of the first, second, third, or fourth modular units 1, 2, 3, 4) via insertion of fasteners (e.g., nails, screws, or any other suitable attachment type without limitation) through the fastener holes 601 and into the modular unit. In some embodiments, the front wall 610, the retention tab 620, and the top wall 630 are formed (e.g., by extrusion or any other suitable technique) as a unitary, or monolithic, structure. In some embodiments, the entire sixth connector 600 can be formed as a unitary, or monolithic, structure, such as via an additive manufacturing technique (e.g., using a so-called 3D printer). The quantity of the fastener holes 601 is merely exemplary and fewer or more fastener holes 601 can be provided; also, the fastening holes 601 can be formed at other locations of the sixth connector 600 from those shown in FIGS. 10A through 10D.

The cladding alignment feature 612 has a generally mushroom-shaped profile, in which a collar of the cladding alignment feature 612 that is directly attached to the front wall 610 has a smaller diameter than a distal knob of the cladding alignment feature 612 that is spaced apart from the surface of the front wall 610 by the collar of the cladding alignment feature 612. Thus, the cladding alignment feature 612 is positioned, shaped, and configured to fit within (e.g., lockingly within) eyelets or other recesses in a cladding panel for securing the cladding panel to the exterior surface of the building.

Figure 10A:
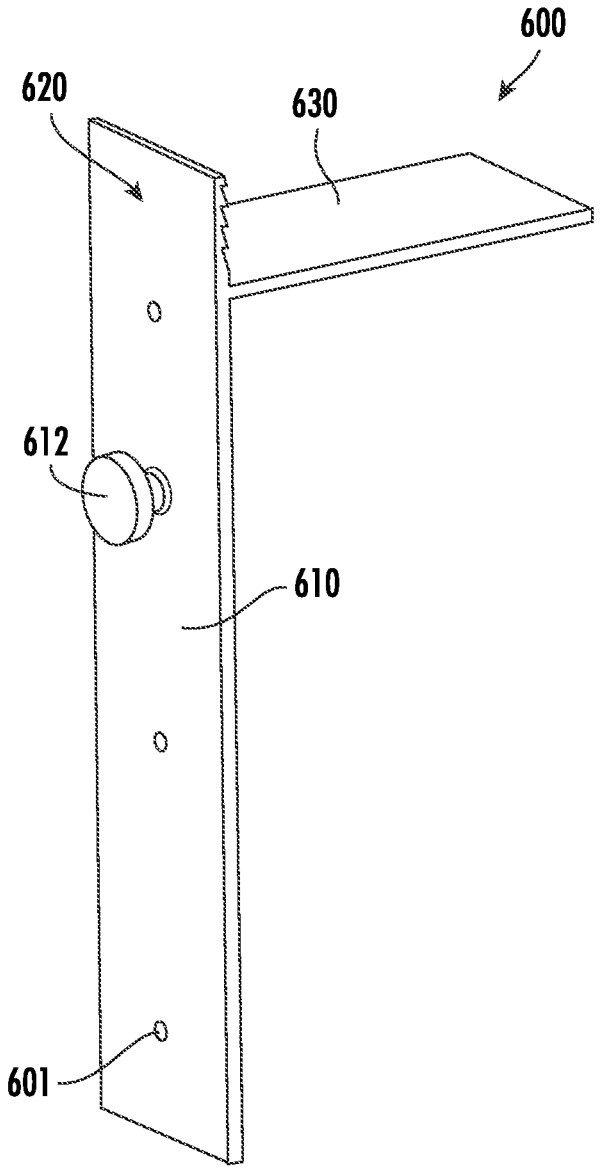
FIG. 10A is an isometric view of an example embodiment of a sixth connector compatible with the fifth connector, both of which are suitable for use in a further example embodiment of a connector system.
Figure 10B:
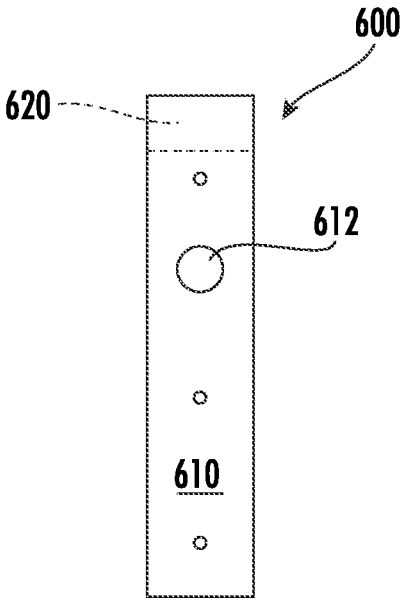
FIG. 10B is a front view of the sixth connector of FIG. 10A.
Figure 10C:
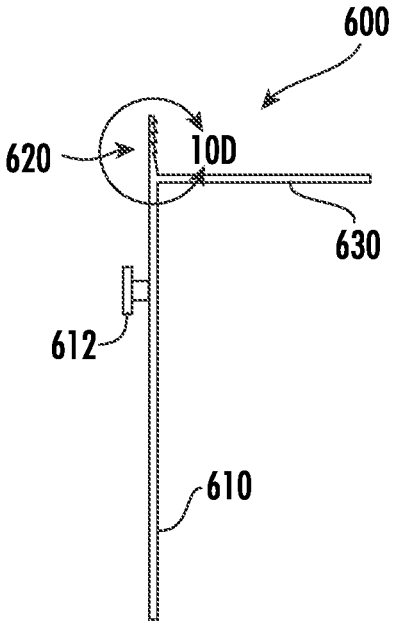
FIG. 10C is a side view of the sixth connector of FIG. 10A.
Figure 10D:
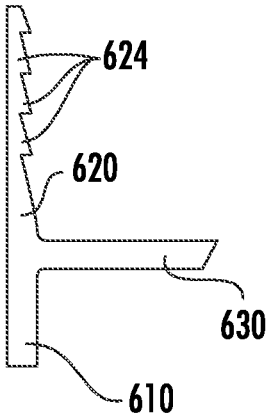
FIG. 10D is a detailed view of the portion of the sixth connector, as indicated in FIG. 10C.

The retention tab 620 has, as best illustrated in the detailed view of FIG. 10D, one or more of (e.g., a plurality of) serrations 624 formed on a surface of the retention tab 620 so as to engage with the serrations (e.g., 124, 324, 524) of the retention clip (e.g., 120, 320, 520) of a designated one of the first, third, or fifth connectors 100, 300, 500 when the retention tab 620 is inserted into the gap (e.g., 126, 326, 526) of the designated retention clip 120, 320, 520. While the foregoing description of the engagement of the retention tab 620 with a designated retention clip of another connector refers to the retention clip 520 of the fifth connector 500, it is noted that the engagement of the retention tab 620 is substantially similar (e.g., identical) for any of the other retention clips (e.g., 120, 320) of any of the other connectors (e.g., first and third connectors 100, 300).

To ensure engagement of the serrations 624 of the retention tab 620 with the serrations 524 of the retention clip 520, the serrations 624 of the retention tab 620 and the serrations 524 of the retention clip 520 extend in opposing directions. The serrations 524, 624 engage with each other to resist a relative movement of the retention tab 620 out of the gap 526 of the retention clip 520, opposite the direction of insertion. As the retention tab 620 is inserted into the retention clip 520 (e.g., after the retention tab 620 has been inserted at least partially within the gap 526), the retention tab 620 deforms (e.g., via bending) the finger 522 of the retention clip 520, thereby widening the gap 526, at least during insertion and/or while the retention tab 620 is engaged within the retention clip 520. This deformation of the finger 522 causes the finger 522 to exert, in the direction of front wall 510, a compressive force, which presses the serrations 624 of the retention tab 620 against (e.g., to engage, or nest, within each other) the serrations 524 of the retention clip 520. This compressive force generated by the finger 522 thus resists the serrations 524, 624 from being disengaged from each other and, thus, resists disengagement of the retention tab 620 from the retention clip 520. The finger 522 is advantageously formed such that, at the entrance (e.g., the open end) of the gap 526, at least the distal end of the finger 522 remains spaced apart from (e.g., is not flush with) the surface of the retention tab 620 that the finger 522 presses against; thus, the finger 522 can be further deformed (e.g., in the direction away from the front wall 510) to allow for a controlled, or selectable, disengagement of the retention tab 620 from the retention clip 520, such as may be advantageous, for example, if the first connector 100 and the third connector 300 do not properly engage with one another to secure laterally adjacent modular units together. The engagement of the serrations 524, 624 thus resists relative vertical displacement of the modular units to which the fifth and sixth connectors 500, 600 are attached but provides only negligible (e.g., only due to friction between the serrations 524, 624) resistance against lateral displacements of the modular units to which the fifth and sixth connectors 500, 600 are attached.

Thus, the connector system 10 can include any number of first connectors 100, second connectors 200, third connectors 300, fourth connectors 400, fifth connectors 500, and/or sixth connectors 600 in order to rigidly interconnect and/or attach together immediately adjacent (e.g., vertically and/or laterally) modular units during construction of a building from a plurality of such modular units.

According to an example embodiment, the fifth connectors 500 can be attached in a pattern (e.g., having a uniform pitch therebetween) along a first edge (e.g., a top or bottom edge) of the second modular unit 2 and the sixth connectors 600 can be attached in a pattern (e.g., having a same pattern and pitch as for the fifth connectors 500) along an edge of the first modular unit 1, which is vertically adjacent to the first edge of the second modular unit 2 when the first modular unit 1 is stacked on top of the second modular unit 2. Prior to the first modular unit 1 being stacked on top of the second modular unit 2, each of the fifth connectors 500 are aligned with a corresponding one of the sixth connectors 600, such that the retention tab 620 formed on the front wall 610 of the sixth connectors 600 is insertable within a gap 526 formed within the retention clip 520 of a corresponding one of the fifth connectors 500. As noted elsewhere herein, the retention tab 620 of the sixth connector 600 has serrations 624 that are substantially similar to the serrations 224, 424 of the retention tab 220, 420 of the second and fourth connectors 200, 400, while the retention clip 520 of the fifth connector 500 has serrations 524 that are substantially similar to the serrations 124, 324 of the retention clip 120, 320 of the first and third connectors 100, 300. As such, the finger 522 of the retention clip 520 of the fifth connector 500 presses the retention tab 620 against surface of the retention clip 520 (e.g., the front wall 510) of the fifth connector 500, such that the serrations 624 of the retention tab 620 and the serrations 524 of the retention clip 520 interlock with each other to resist removal of the retention tab 620 when in an installed position within the gap 526 of the retention clip 520, just as was described relative to the retention tab 220, 420 of the second and fourth connectors 200, 400 and the retention clip 120, 320 of the first and third connectors 100, 30. The front wall 510, 610 of each of the fifth and sixth connectors 500, 600 has a cladding alignment feature 512, 612 protruding from the surface thereof. The cladding alignment feature 512, 612 of the fifth and sixth connectors 500, 600 is substantially identical to the cladding alignment features 112, 212, 312, 412 described elsewhere herein regarding the first, second, third, and fourth connectors 100, 200, 300, 400.

All of the connectors (e.g., 100, 200, 300, 400, 500, 600) are advantageously attached to a corresponding modular unit (e.g., 1, 2, 3, 4) of a plurality of modular units that are designated to be rigidly attached (e.g., directly) to each other during construction of the building and/or structure. Such connectors are attached to the corresponding modular unit during pre-fabrication of the modular unit, such as, for example, in a factory or other suitable place of pre-fabrication. As such, since the modular units are transported in a fully assembled configuration in which all of the respective connectors rigidly affixed thereto are in place and rigidly affixed to the modular unit during transport of the modular unit to the site where the building is being constructed, it is advantageous in some embodiments for the retention tabs (e.g., 220, 420, 620) to be positioned on an upper surface or edge of the modular unit (e.g., the surface of the modular unit furthest away from the surface on which the modular unit is transported, such as a bed of a trailer or truck). By this arrangement, the retention tabs will not be extending towards the transport surface, or otherwise in a position to contact the transport surface, since such direct contact with the transport surface may result in damage (e.g., due to deformation) to the retention tabs. In some embodiments, the transport surface may have slots formed therein, into which retention tabs extending beyond a bottom surface (e.g., plane) of such modular unit are insertable during transport to ensure that the connectors having such retention tabs are installed at proper positions on and/or about the modular unit before leaving the factory, such that improperly installed connectors can be reworked at the factory rather than at the construction site. Such slots on the transport surface can be provided, for example, in a removable plate, or jig, that corresponds to the specified arrangement and/or alignment of connectors for one or more modular units. In such embodiments, the removable plate may be reused as necessary. In some embodiments, the connectors that are attached on the lower surface or edge of a modular unit are advantageously coplanar with, or recessed from (e.g., vertically above), the lower surface (e.g., plane) or edge of the modular unit to which each such connector is respectively attached, such that no portion of the connector extends beyond the bottom surface of the modular unit to which such connector is attached. Stated differently, it is advantageous for no portion(s) of the connectors attached to a lower surface (e.g., plane) or edge of a modular unit to extend beyond the lower surface or edge of the modular unit.

The connector systems 10 disclosed herein are advantageous at least in that they allow for modular units to be assembled together more quickly and with greater precision and accuracy at the site where the building is under construction, compared to conventional assembly systems and techniques. Additionally, such connector systems 10 as are disclosed herein act to resist vertical lift and lateral shear between vertically adjacent and/or laterally adjacent modular units after assembly thereof, during construction of the building. Furthermore, such connector systems 10 as are disclosed herein provide a plurality of rigid and precisely located attachment points where an external cladding can be affixed to cover an exterior of the modular unit(s) and the building being constructed. In some embodiments, the cladding panels can be attached to less than all of the cladding alignment features attached to the modular units of the building. As such, pluralities of at least each of the first, second, third, and fourth connectors and, optionally, the fifth and sixth connectors are used as a connector system 10 to secure laterally adjacent and/or vertically adjacent modular units together and prevent relative movements therebetween.

The present subject matter can be embodied in other forms without departure from the spirit and essential characteristics thereof. The embodiments described therefore are to be considered in all respects as illustrative and not restrictive. Although the present subject matter has been described in terms of certain specific embodiments, other embodiments that are apparent to those of ordinary skill in the art are also within the scope of the present subject matter.

The invention claimed is:

1. A connector system for rigidly interconnecting a plurality of modular units of a structure, the connector system comprising:

a first connector configured for attachment at an attachment position of a first modular unit of the plurality of modular units, the first connector comprising a vertically extending retention clip, an alignment slot, and a channel;

a second connector configured for attachment at an attachment position of a second modular unit of the plurality of modular units, the second connector comprising a retention tab, an alignment slot, and a channel, wherein the second modular unit is vertically adjacent to the first modular unit, such that the attachment position of the second modular unit is directly below the attachment position of the first modular unit when the connector system is in an assembled state;

a third connector configured for attachment at an attachment position of a third modular unit of the plurality of modular units, the third connector comprising a retention clip and an alignment peg, wherein the third modular unit is laterally adjacent to the first modular unit, such that the attachment position of the third modular unit is directly beside the attachment position of the first modular unit when the connector system is in the assembled state; and a fourth connector configured for attachment at an attachment position of a fourth modular unit of the plurality of modular units, the fourth connector comprising a retention tab and an alignment peg, wherein the fourth modular unit is laterally adjacent to the second modular unit and vertically adjacent to the third modular unit, such that the attachment position of the fourth modular unit is directly beside the attachment position of the second modular unit and directly below the attachment position of the third modular unit when the connector system is in the assembled state;

wherein the retention tab of the second connector is configured for vertical insertion into the retention clip of the first connector to resist vertical movement of the first connector relative to the second connector;

wherein the retention tab of the fourth connector is configured for vertical insertion into the retention clip of the third connector to resist vertical movement of the fourth connector relative to the third connector;

wherein the alignment peg of the third connector is configured for sliding engagement within the channel of the first connector to resist lateral movement of the first connector relative to the third connector;

wherein the alignment peg of the fourth connector is configured for sliding engagement within the channel of the second connector to resist lateral movement of the second connector relative to the fourth connector; and wherein relative movement between the first, second, third, and fourth modular units is resisted by respective engagements between the first, second, third, and fourth connectors.

2. The connector system of claim 1, wherein:

the retention clip of the first connector comprises a finger attached to a front wall of the first connector and a plurality of serrations, wherein the finger is spaced apart from the front wall of the first connector by a gap;

the retention tab of the second connector comprises a plurality of serrations formed on an external surface of the retention tab that faces towards the plurality of serrations of the retention clip of the first connector when the retention tab is inserted into the gap of the retention clip; and the finger of the retention clip of the first connector is configured to exert a compressive force on the retention tab of the second connector when the retention tab is inserted into the gap of the retention clip, such that the plurality of serrations of the retention tab are pressed against and interlockingly engaged with the plurality of serrations of the retention clip; and/or wherein:

the retention clip of the third connector comprises a finger attached to a front wall of the third connector and a plurality of serrations, wherein the finger is spaced apart from the front wall of the third connector by a gap; the retention tab of the fourth connector comprises a plurality of serrations formed on an external surface of the retention tab that faces towards the plurality of serrations of the retention clip when the retention tab is inserted into the gap of the retention clip of the third connector when the retention tab is inserted into the gap of the retention clip; and the finger of the retention clip of the third connector is configured to exert a compressive force on the retention tab of the fourth connector when the retention tab is inserted into the gap of the retention clip, such that the plurality of serrations of the retention tab are pressed against and interlockingly engaged with the plurality of serrations of the retention clip.

3. The connector system of claim 2, wherein:

when the alignment peg of the third connector is positioned within the channel of the first connector, relative movement between the first connector and the third connector is restricted in all directions other than a direction of the sliding engagement of the alignment peg of the third connector within the channel of the first connector; and/or when the alignment peg of the fourth connector is positioned within the channel of the second connector, relative movement between the second connector and the fourth connector is restricted in all directions other than a direction of the sliding engagement of the alignment peg of the third connector within the channel of the first connector.

4. The connector system of claim 3, wherein the alignment slot of each of the first and second connectors has a tapered shape between an inlet of the alignment slot and the channel, such that a width of the alignment slot at the inlet is greater than a width of the channel at any point along a length of the channel.

5. The connector system of claim 4, wherein:

the width of the channel of the first connector is greater than or equal to a diameter of a collar of the alignment peg of the third connector and is smaller than a diameter of a head of the alignment peg of the third connector; and/or the width of the channel of the second connector is greater than or equal to a diameter of a collar of the alignment peg of the fourth connector and is smaller than a diameter of a head of the alignment peg of the fourth connector.

6. The connector system of claim 5, wherein the length of the channel of the first connector is an axial length and is greater than an axial length of the retention tab of the fourth connector, such that, during assembly of the connector system, the alignment peg of the third connector is inserted into the channel of the first connector before the retention tab of the fourth connector is inserted into the retention clip of the third connector, such that engagement of the alignment peg of the third connector within the channel of the first connector ensures the retention tab of the fourth connector is axially aligned with the gap of the retention clip of the third connector.

7. The connector system of claim 5, wherein the alignment peg comprises a collar and a radially extending head, the head being wider than the width of the channel.

8. The connector system of claim 4, wherein:

the alignment peg of the third connector is provided on a side wall of the third connector;

the alignment slot of the first connector is provided on a side wall of the first connector and comprises opposing flanges that, together, define the tapered shape of the alignment slot and also the width of the channel of the second connector and are shaped to prevent removal of the alignment peg of the third connector from the channel of the first connector in a lateral direction;

the alignment peg of the fourth connector is provided on a side wall of the fourth connector; and the alignment slot of the second connector is provided on a side wall of the second connector and comprises opposing flanges that, together, define the tapered shape of the alignment slot and also the width of the channel of the second connector and are shaped to prevent removal of the alignment peg of the fourth connector from the channel of the second connector in the lateral direction.

9. The connector system of claim 8, wherein:

the side wall and the front wall of the first connector are joined to each other at an angle;

the side wall and the front wall of the second connector are joined to each other at an angle;

the side wall and the front wall of the third connector are joined to each other at an angle; and the side wall and the front wall of the fourth connector are joined to each other at an angle.

10. The connector system of claim 9, wherein, when the connector system is in the assembled state:

the side walls of the first, second, third, and fourth connectors are each parallel to each other; and/or the front walls of the first, second, third, and fourth connectors are each parallel to and/or coplanar with each other.

11. The connector system of claim 10, wherein:

the second connector comprises a top wall configured for attachment to a top surface of the second modular unit; and the fourth connector comprises a top wall configured for attachment to a top surface of the fourth modular unit.

12. The connector system of claim 11, wherein:

the side wall and the front wall of the first connector each extend in a respective plane that is perpendicular to each other;

the side wall, the front wall, and the top wall of the second connector each extend in a respective plane that is perpendicular to each other;

the side wall and the front wall of the third connector each extend in a respective plane that is perpendicular to each other; and the side wall, the front wall, and the top wall of the fourth connector each extend in a respective plane that is perpendicular to each other.

13. The connector system of claim 1, wherein each of the first, second, third, and fourth connectors comprises a cladding alignment feature on a front wall thereof, each cladding alignment feature being configured to secure a cladding member or panel to the first, second, third, and fourth connectors.

14. The connector system of claim 1, comprising:

one or more fifth connectors arranged along a lower edge of the first modular unit and/or along a lower edge of the third modular unit according to a predetermined pattern, each of the one or more fifth connectors comprising a retention clip; and one or more sixth connectors arranged along an upper edge of the second modular unit and/or along an upper edge of the fourth modular unit according to the predetermined pattern, each of the one or more sixth connectors comprising a retention tab;

wherein, when the connector system is in the assembled state, the upper edge of the second modular unit is adjacent to the lower edge of the first modular unit and the upper edge of the fourth modular unit is adjacent to the lower edge of the third modular unit; and wherein the retention tab of each of the one or more sixth connectors is configured for vertical insertion into the retention clip of a corresponding fifth connector of the one or more fifth connectors to resist vertical movement of the first modular unit relative to the second modular unit and/or of the third modular unit relative to the fourth modular unit.

15. The connector system of claim 1, wherein a direction of the sliding engagement of the alignment peg of the third connector within the alignment slot of the first connector is coaxial with a direction of insertion of the retention tab of the second connector into the retention clip of the first connector.

16. The connector system of claim 1, wherein the retention tab of the fourth connector can only be vertically inserted into the retention clip of the third connector when the alignment peg of the third connector is positioned within the channel of the first connector.

17. The connector system of claim 1, wherein:

the attachment position of the first modular unit is a corner of the first modular unit;

the attachment position of the second modular unit is a corner of the second modular unit;

the attachment position of the third modular unit is a corner of the third modular unit; and/or the attachment position of the fourth modular unit is a corner of the fourth modular unit.

18. A method of rigidly interconnecting a plurality of modular units of a structure, the method comprising:

attaching a first connector of a connector system at an attachment position of a first modular unit of the plurality of modular units, the first connector comprising a vertically extending retention clip, an alignment slot, and a channel;

attaching a second connector of the connector system at an attachment position of a second modular unit of the plurality of modular units, the second connector comprising a retention tab, an alignment slot, and a channel, wherein the second modular unit is vertically adjacent to the first modular unit, such that the attachment position of the second modular unit is directly below the attachment position of the first modular unit when the connector system is in an assembled state;

attaching a third connector of the connector system at an attachment position of a third modular unit of the plurality of modular units, the third connector comprising a retention clip and an alignment peg, wherein the third modular unit is laterally adjacent to the first modular unit, such that the attachment position of the third modular unit is directly beside the attachment position of the first modular unit when the connector system is in the assembled state;

attaching a fourth connector of the connector system at an attachment position of a fourth modular unit, the fourth connector comprising a retention tab and an alignment peg, wherein the fourth modular unit is laterally adjacent to the second modular unit and vertically adjacent to the third modular unit, such that the attachment position of the fourth modular unit is directly beside the attachment position of the second modular unit and directly below the attachment position of the third modular unit when the connector system is in the assembled state;

vertically inserting the retention tab of the second connector into the retention clip of the first connector to resist vertical movement of the first connector relative to the second connector;

vertically inserting the retention tab of the fourth connector into the retention clip of the first connector to resist vertical movement of the first connector relative to the second connector;

slidably engaging the alignment peg of the third connector within the channel of the first connector to resist lateral movement of the first connector relative to the third connector;

slidably engaging the alignment peg of the fourth connector within the channel of the second connector to resist lateral movement of the second connector relative to the fourth connector; and resisting relative movement between the first, second, third, and fourth modular units by respective engagements between the first, second, third, and fourth connectors.

19. The method of claim 18, wherein:

the retention clip of the first connector comprises a finger attached to a front wall of the first connector and a plurality of serrations, wherein the finger is spaced apart from the front wall of the first connector by a gap; and the retention tab of the second connector comprises a plurality of serrations formed on an external surface of the retention tab that faces towards the plurality of serrations of the retention clip of the first connector when the retention tab is inserted into the gap of the retention clip; and/or wherein:

the retention clip of the third connector comprises a finger attached to a front wall of the third connector and a plurality of serrations, wherein the finger is spaced apart from the front wall of the third connector by a gap; and the retention tab of the fourth connector comprises a plurality of serrations formed on an external surface of the retention tab that faces towards the plurality of serrations of the retention clip when the retention tab is inserted into the gap of the retention clip of the third connector when the retention tab is inserted into the gap of the retention clip;

the method comprising:

exerting, using the finger of the retention clip of the first connector, a compressive force on the retention tab of the second connector when the retention tab is inserted into the gap of the retention clip, such that the plurality of serrations of the retention tab are pressed against and interlockingly engaged with the plurality of serrations of the retention clip; and/or exerting, using the finger of the retention clip of the third connector, a compressive force on the retention tab of the fourth connector when the retention tab is inserted into the gap of the retention clip, such that the plurality of serrations of the retention tab are pressed against and interlockingly engaged with the plurality of serrations of the retention clip.

20. The method of claim 19, wherein:

when the alignment peg of the third connector is positioned within the channel of the first connector, relative movement between the first connector and the third connector is restricted in all directions other than a direction of the sliding engagement of the alignment peg of the third connector within the channel of the first connector; and/or when the alignment peg of the fourth connector is positioned within the channel of the second connector, relative movement between the second connector and the fourth connector is restricted in all directions other than a direction of the sliding engagement of the alignment peg of the third connector within the channel of the first connector.

21. The method of claim 20, wherein the alignment slot of each of the first and second connectors has a tapered shape between an inlet of the alignment slot and the channel, such that a width of the alignment slot at the inlet is greater than a width of the channel at any point along a length of the channel.

22. The method of claim 21, wherein:

the width of the channel of the first connector is greater than or equal to a diameter of a collar of the alignment peg of the third connector and is smaller than a diameter of a head of the alignment peg of the third connector; and/or the width of the channel of the second connector is greater than or equal to a diameter of a collar of the alignment peg of the fourth connector and is smaller than a diameter of a head of the alignment peg of the fourth connector.

23. The method of claim 22, wherein the length of the channel of the first connector is an axial length and is greater than an axial length of the retention tab of the fourth connector;

the method comprising, during assembly of the connector system, inserting the alignment peg of the third connector into the channel of the first connector before the retention tab of the fourth connector is inserted into the retention clip of the third connector, such that engagement of the alignment peg of the third connector within the channel of the first connector ensures the retention tab of the fourth connector is axially aligned with the gap of the retention clip of the third connector.

24. The method of claim 22, wherein the alignment peg comprises a collar and a radially extending head, the head being wider than the width of the channel.

25. The method of claim 21, wherein:

the alignment peg of the third connector is provided on a side wall of the third connector;

the alignment slot of the first connector is provided on a side wall of the first connector and comprises opposing flanges that, together, define the tapered shape of the alignment slot and also the width of the channel of the second connector and are shaped to prevent removal of the alignment peg of the third connector from the channel of the first connector in a lateral direction;

the alignment peg of the fourth connector is provided on a side wall of the fourth connector; and the alignment slot of the second connector is provided on a side wall of the second connector and comprises opposing flanges that, together, define the tapered shape of the alignment slot and also the width of the channel of the second connector and are shaped to prevent removal of the alignment peg of the fourth connector from the channel of the second connector in the lateral direction.

26. The method of claim 25, wherein:

the side wall and the front wall of the first connector are joined to each other at an angle;

the side wall and the front wall of the second connector are joined to each other at an angle;

the side wall and the front wall of the third connector are joined to each other at an angle; and the side wall and the front wall of the fourth connector are joined to each other at an angle.

27. The method of claim 26, wherein, when the connector system is in the assembled state:

the side walls of the first, second, third, and fourth connectors are each parallel to each other; and/or the front walls of the first, second, third, and fourth connectors are each parallel to and/or coplanar with each other.

28. The method of claim 27, wherein:

the second connector comprises a top wall configured for attachment to a top surface of the second modular unit; and the fourth connector comprises a top wall configured for attachment to a top surface of the fourth modular unit.

29. The method of claim 28, wherein:

the side wall and the front wall of the first connector each extend in a respective plane that is perpendicular to each other;

the side wall, the front wall, and the top wall of the second connector each extend in a respective plane that is perpendicular to each other;

the side wall and the front wall of the third connector each extend in a respective plane that is perpendicular to each other; and the side wall, the front wall, and the top wall of the fourth connector each extend in a respective plane that is perpendicular to each other.

30. The method of claim 18, wherein each of the first, second, third, and fourth connectors comprises a cladding alignment feature on a front wall thereof;

the method comprising securing, using each cladding alignment feature, a cladding member or panel to the first, second, third, and fourth connectors.

31. The method of claim 18, comprising:

arranging one or more fifth connectors along a lower edge of the first modular unit and/or along a lower edge of the third modular unit according to a predetermined pattern, each of the one or more fifth connectors comprising a retention clip;

arranging one or more sixth connectors along an upper edge of the second modular unit and/or along an upper edge of the fourth modular unit according to the predetermined pattern, each of the one or more sixth connectors comprising a retention tab; and vertically inserting the retention tab of each of the one or more sixth connectors into the retention clip of a corresponding fifth connector of the one or more fifth connectors to resist vertical movement of the first modular unit relative to the second modular unit and/or of the third modular unit relative to the fourth modular unit;

wherein, when the connector system is in the assembled state, the upper edge of the second modular unit is adjacent to the lower edge of the first modular unit and the upper edge of the fourth modular unit is adjacent to the lower edge of the third modular unit.

32. The method of claim 18, wherein a direction of the sliding engagement of the alignment peg of the third connector within the alignment slot of the first connector is coaxial with a direction of insertion of the retention tab of the second connector into the retention clip of the first connector.

33. The method of claim 18, wherein the retention tab of the fourth connector can only be vertically inserted into the retention clip of the third connector when the alignment peg of the third connector is positioned within the channel of the first connector.

34. The method of claim 18, wherein:

the attachment position of the first modular unit is a corner of the first modular unit;

the attachment position of the second modular unit is a corner of the second modular unit;

the attachment position of the third modular unit is a corner of the third modular unit; and/or the attachment position of the fourth modular unit is a corner of the fourth modular unit.

* * * * *